US005328812A

United States Patent [19]

Haijima et al.

[11] Patent Number: 5,328,812

[45] Date of Patent: Jul. 12, 1994

[54] METHOD OF FORMING A SILVER/HALIDE COLOR IMAGE USING A PARTICULAR ACYLACETAMIDE YELLOW COUPLER AND PARTICULAR COLOR DEVELOPERS

[75] Inventors: Akimitsu Haijima; Masato Taniguchi, both of Kanagawa, Japan

[73] Assignee: Fuji Photo Film Co., Ltd., Kanagawa, Japan

[21] Appl. No.: 19,305

[22] Filed: Feb. 18, 1993

[30] Foreign Application Priority Data

Feb. 18, 1992 [JP] Japan ..... 4-060992

[51] Int. Cl.[5] ..... G03C 7/46; G03C 5/18; G03C 1/08; G03C 7/26

[52] U.S. Cl. ..... 430/388; 430/435; 430/442; 430/467; 430/484; 430/389; 430/472; 430/475; 430/556; 430/557

[58] Field of Search ..... 430/380, 435, 442, 467, 430/484, 485, 388, 389, 472, 475, 556, 557

[56] References Cited

U.S. PATENT DOCUMENTS

| | | | |
|---|---|---|---|
| 3,705,035 | 12/1972 | Vetter et al. | 430/376 |
| 3,920,739 | 11/1975 | Suda et al. | 564/98 |
| 5,176,987 | 1/1993 | Nakamura et al. | 430/380 |
| 5,250,406 | 10/1993 | Yamamoto et al. | 430/556 |

FOREIGN PATENT DOCUMENTS

| | | | |
|---|---|---|---|
| 0410450 | 1/1991 | European Pat. Off. . | |
| 0447969 | 9/1991 | European Pat. Off. . | |
| 0503658 | 9/1992 | European Pat. Off. | 430/388 |
| 2090656 | 4/1987 | Japan | 430/467 |
| 3291650 | 12/1991 | Japan | 430/467 |
| 4011255 | 1/1992 | Japan . | |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A dye image-forming method comprising color developing an image wise exposed silver halide color photographic material comprising a support having thereon a layer containing an acylacetamide yellow coupler having an acyl group represented by a following formula (YI)

(YI)

wherein $R_1$ represents a monovalent group; Q represents a group of atoms necessary to form 3- or 5-membered hydrocarbon ring or a 3- to 5-membered heterocylcic ring; provided that $R_1$ is not a hydrogen atom and is not combined with Q to form a ring; with a developing solution containing at least one aromatic primary amine color developing agent represented by formula (D) or (E):

(D)

wherein $R_4$ represents a linear or branched alkyl group having 1 to 6 carbon atoms or a linear or branched hydroxyalkyl group having 3 to 6 carbon atoms; $R_5$ represents a linear or branched alkylene group having 3 to 6 carbon atoms or a linear or branched hydroxyalkylene group having 3 to 6 carbon atoms; $R_6$ represents a hydrogen atom, a linear or branched alkyl group having 1 to 4 carbon atoms or a linear or branched alkyl group having 1 to 4 carbon atoms or a linear or branched alkoxy group having 1 to 4 carbon atoms;

(Abstract continued on next page.)

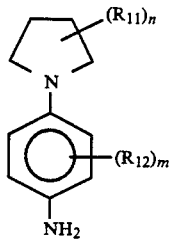
(E) wherein $R_{11}$ nd $R_{12}$ each represents a substituent; n represents 0 or an integer of 1 to 8, and m represents 0 or an integer of 1 to 4.
13 Claims, No Drawings

METHOD OF FORMING A SILVER/HALIDE COLOR IMAGE USING A PARTICULAR ACYLACETAMIDE YELLOW COUPLER AND PARTICULAR COLOR DEVELOPERS

FIELD OF THE INVENTION

The present invention relates to a method for forming a color dye with a silver halide color photographic material, more specifically to a dye image-forming method in which on color development, the fastness of the color image and rapid processing are markedly improved.

BACKGROUND OF THE INVENTION

It is well-known that an aromatic primary amine color developing agent oxidized by exposed silver halide used as an oxidizing agent, reacts with a coupler to prepare indophenol, indoaniline, indamine, azomethine, phenoxazine, phenazine, and analogous dyes, whereby a color image is formed.

Of them, an acylacetoamide coupler represented by a benzoyl acetanilide coupler and pivaloyl acetanilide coupler is generally used for forming a yellow color image.

In general, benzoyl acetoanilide couplers have excellent characteristics in that high coupling activity with the aromatic primary amine developing agent on development is high and in that the yellow dye produced has a large molecular extinction coefficient. However, they have the defect that they provide a low fastness of a color image on storage in the dark. While pivaloyl acetamide type couplers have an excellent color image fastness, they have a low coupling reactivity on development and a small molecular extinction coefficient. Therefore obtaining a sufficient color image density requires the use of more coupler, which provides a disadvantage in terms of either image quality or cost.

Thus, the development of a yellow coupler having a high color development (a high coupling activity of a coupler and a high molecular extinction coefficient of a formed dye) and an excellent dye image fastness is attempted as described in, for example, European Patent EP 0 447 969 A1.

While the yellow coupler described in European Patent EP 0 447 969 A1 improves color development and dye image fastness on storage in the dark, color image fastness on light irradiation is deteriorated and therefore an improvement therein has been required.

Meanwhile, recent improvements in operability and requirements of general users have affirmatively promoted low replenishment of the developing solution and rapid processing. A method in which the pH of the developing solution and the processing temperature are increased has been tried as a means to solve this problem. However, there is involved in this method the problem that photographic performance is changed to a large extent during continuous processing and the stability of the developing solution is deteriorated. Therefore it is not suitable for practical use. Another method disclosed in EP 410 450 A2 comprises processing with a developing solution containing a specific developing agent to achieve rapid processing.

However, the above patent discloses that maximum density (Dmax) and sensitivity are lowered with a light-sensitive material containing silver halide having a low silver chloride content (80 mole % or less) even if one of the color developing agents described in this patent is used, and this can not be improved even by prolonging the developing time. Thus, it is impossible to shorten the processing time by a developing agent in a color negative light-sensitive material containing 60 mole % or more of conventional silver bromide.

SUMMARY OF THE INVENTION

The present invention relates to a color photographic material which comprises silver halide emulsion layer containing 60 mole % or more of silver bromide. Surprisingly, the yellow coupler described in EP 0 447 969 A1 was processed in the color developing solution described in EP 410 450 A2 or containing the developing agent of the present invention and it was found that developing time could be shortened and further color image fastness on light irradiation was markedly improved and that a dye image fastness under humid and hot conditions and maximum color density are improved.

Thus, an object of the present invention is to provide an image-forming method by which processing rapidity is improved and further color development and color image fastness on storage in the dark and light irradiation also are improved in a light-sensitive material in which a yellow image-forming coupler providing excellent color development and excellent color image fastness on storage in the dark is used.

The above object can be achieved by the present invention as described below.

That is, the present invention provides a color image-forming method comprising color developing a silver halide color photographic material containing at least one acylacetamide yellow coupler having an acyl group represented by the following Formula (YI):

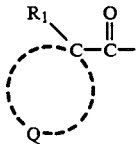

Formula (YI)

wherein $R_1$ represents a monovalent group; Q represents a group of atoms necessary to form a 3-to 5-membered hydrocarbon ring or a 3-to 5-membered heterocyclic ring having therein at least one hereto atom selected from N, O, S and P together with C; provided that $R_1$ is not a hydrogen atom and is not combined with Q to form a ring; with a developing solution containing at least one of the aromatic primary amine color developing agents represented by the following Formula (D) or (E):

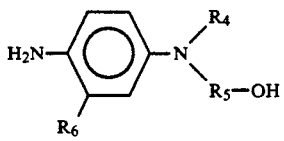

Formula (D)

wherein $R_4$ represents a linear or branched alkyl group having 1 to 6 carbon atoms or a linear or branched hydroxyalkyl group having 3 to 6 carbon atoms; $R_5$ represents a linear or branched alkylene group having 3 to 6 carbon atoms or a linear or branched hydroxyalkylene group having 3 to 6 carbon atoms; $R_6$ represents a hydrogen atom, a linear or branched alkyl group having 1 to 4 carbon atoms or a linear or branched alkoxy group having 1 to 4 carbon atoms;

Formula (E)

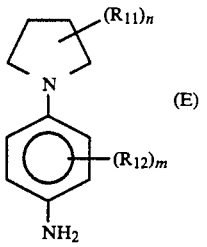

(E)

wherein $R_{11}$ represents a substituent; n represents 0 or an integer of 1 to 8, provided that when n is 2 or more, $R_{11}$'s may be the same or different from each other; $R_{12}$ represents a substituent; and m represents 0 or an integer of 1 to 4, provided that when m is 2 or more, $R_{12}$ may be the same or different from each other and may form a ring.

DETAILED DESCRIPTION OF THE INVENTION

The silver halide used in emulsion layers of the present invention preferably contains 60 mole % or more of silver bromide, more preferably silver bromochloride, silver bromoiodide, silver bromochloroiodide or silver bromide, in which 60 mole % or more of silver bromide is contained. In the silver bromoiodide and silver bromochloroiodide, silver iodide is preferably contained in 2 to 20 mole %.

The acylacetamide type yellow coupler used in the present invention and having the acyl group represented by Formula (YI) is explained in more detail below.

The acylacetamide type yellow coupler of the present invention is represented preferably by the following Formula (YII):

(YII)

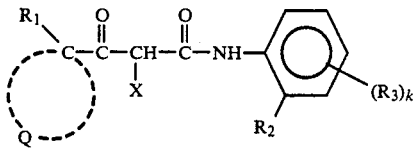

wherein $R_1$ represents a monovalent atom or group excluding a hydrogen atom; Q represents a group of atoms necessary to form a 3-to 5-membered hydrocarbon ring or a 3- to 5-membered heterocyclic ring having therein at least one hetero atom selected from N, S, O and P together with C; $R_2$ represents a hydrogen atom, a halogen atom (F, Cl, Br and I; hereinafter the same in the explanation of Formula (Y)), an alkoxy group, an aryloxy group, an alkyl group, or an amino group; $R_3$ represents a group capable of substitution on a benzene ring; X represents a hydrogen atom or a group capable of release upon a coupling reaction with the oxidation product of an aromatic primary amine developing agent (hereinafter referred to as a release group); and k represents 0 or an integer of 1 to 4, provided that when k is plural, the plurality of $R_3$ may be the same or different.

$R_1$ is preferably an organic group containing no metal atom, more preferably a hydrocarbon group which may have a substituent.

Examples of $R_3$ include a halogen atom, an alkyl group, an aryl group, an alkoxy group, an aryloxy group, an alkoxycarbonyl group, an aryloxycarbonyl group, a carbonamide group, a sulfonamide group, an carbamoyl group, a sulfamoyl group, an alkylsulfonyl group, a ureido group, a sulfamoylamino group, an alkoxycarbonylamino group, an aryloxysulfonyl group, an acyloxy group, a nitro group, a heterocyclic group, a cyano group, an acyl group, an acyloxy group, an alkylsulfonyloxy group, and an arylsulfonyloxy group. Examples of the release group are a heterocyclic group which is bonded to the coupling active site via a nitrogen atom, an aryloxy group, an arylthio group, an acyloxy group, an alkylsulfonyloxy group, an arylsulfonyloxy group, a hetercyclic oxy group, a heterocyclic thio group, and a halogen atom.

When a substituent in Formula (YII) is an alkyl group or contains an alkyl group, the alkyl group can be a linear, branched or cyclic alkyl group which may be substituted and can contain an unsaturated bond, unless specifically defined otherwise (for example, methyl, isopropyl, t-butyl, cyclopentyl, t-pentyl, cyclohexyl, 2-ethylhexyl, 1,1,3,3-tetramethylbutyl, dodecyl, hexadecyl, allyl, 3-cyclohexenyl, oleyl, benzyl, trifluoromethyl, hydroxymethylmethoxy-ethyl, ethoxycarbonylmethyl, and phenoxyethyl).

When the substituent in Formula (YII) is an aryl group or contains an aryl group, the aryl group can be a monocyclic or condensed aryl group which may be substituted, unless specifically defined otherwise (for example, phenyl, 1-naphthyl, p-tolyl, o-tolyl, p-chlorophenyl, 4-methoxyphenyl, 8-quinolyl, 4-hexadecyleoxyphenyl, pentafluorophenyl, p-hydroxyphenyl, p-cyanophenyl, 3-pentadecylphenyl, 2,4-di-t-pentylphenyl, p-methanesulfonamidephenyl, and 3,4-dichlorophenyl).

When the substituent in Formula (YII) is a heterocyclic group or contains a heterocyclic group, the heterocyclic group can be a 3- to 8-membered monocyclic or condensed heterocyclic group which contains at least one hetero atom selected from O, N, S, P, Se and Te in the ring and may be substituted, unless specifically defined otherwise, (for example, 2-furyl, 2-pyridyl, 4-pyridyl, 1-pyrazolyl, 1-imidazolyl, 1-benzotriazolyl, 2-benzotriazolyl, succinimide, phthalimide, and 1-benzyl-2,4-imidazolidinedione-3-yl).

The substituents preferably used in Formula (YII) are explained below.

In Formula (YII), $R_1$ is preferably a halogen atom, a cyano group, or a monovalent group having a total number of 1 to 30 carbon atoms (hereinafter referred to as C number) (for example, an alkyl group, an alkoxy group, and an alkylthio group) or a monovalent group having a C number of 6 to 30 (for example, an aryl group, an aryloxy group, and an arylthio group), each of which may be substituted. Suitable substituents therefor, for example include, a halogen atom, an alkyl group, an alkoxy group, a nitro group, an amino group, a carboamide group, a sulfonamide group, and an acyl group.

In Formula (YII), Q represents a group of non-metallic atoms necessary to form a 3- to 5-membered hydrocarbon ring having a C number of 3 to 30, or a heterocyclic group which contains at least one hetero atom selected from N, S, O and P in the ring and has a C number of 2 to 30, each of which may be substituted, together with C. Further, the ring formed by Q together with C may contain an unsaturated bond therein.

Examples of the ring formed by Q together with C are a cyclopropane ring, a cyclobutane ring, a cyclopentane ring, a cyclopropene ring, a cyclobutene ring, a cyclopentene ring, an oxetane ring, an oxolane ring, a 1,3-dioxolane ring, a thiethane ring, a thiolane ring, and a pyrrolidine ring. Examples of substituents therefor include a halogen atom, a hydroxyl group, an alkyl group, an aryl group, an acyl group, an alkoxy group, an aryloxy group, a cyano group, an alkoxycarbonyl group, an alkylthio group, and an arylthio group.

In Formula (YII), $R_2$ represents preferably a halogen atom, an alkyl group having a C number of 1 to 30, an aryloxy group having a C number of 6 to 30, an alkyl group having a C number of 1 to 30, or an amino group having a C number of 0 to 30, each of which may be substituted. The substituents therefor, for example, can be a halogen atom, an alkyl group, an alkoxy group, and an aryloxy group.

In Formula (YII), $R_3$ represents preferably a halogen atom, an alkyl group having a C number of 1 to 30, an aryl group having a C number of 6 to 30, an alkoxy group having a C number of 1 to 30, an alkoxycarbonyl group having a C number of 2 to 30, an aryloxycarbonyl group having a C number of 7 to 30, a carbonamide group having a C number of 1 to 30, a sulfonamide group having a C number of 1 to 30, a carbamoyl group having a C number of 1 to 30, a sulfamoyl group having a C number of 0 to 30, an ankylsulfonyl group having a C number of 1 to 30, an arylsulfonyl group having a C number of 6 to 30, a ureido group having a C number of 1 to 30, a sulfamoylamino group having a C number of 0 to 30, an alkoxycarbonylamino group having a C number of 2 to 30, a heterocyclic group having a C number of 1 to 30, an acyl group having a C number of 1 to 30, an alkylsulfonyloxy group having a C number of 1 to 30, or an arylsulfonyloxy group having a C number of 6 to 30. Examples of substituents therefor include, for example, a halogen atom, an alkyl group, an aryl group, a heterocyclic group, an alkoxy group, an aryloxy group, a heterocyclic oxy group, an alkylthio group, an arylthio group, a heterocyclic thio group, an alkylsulfonyl group, an arylsulfonyl group, an acyl group, a carbonamide group, a sulfonamide group, a carbamoyl group, a sulfamoyl group, an alkoxycarboylamino group, a sulfamoylamino group, a ureido group, a cyano group, a nitro group, an acyloxy group, an alkoxycarbonyl group, an aryoxycarbonyl group, an alkylsulfonyloxy group, and an arylsulfonyloxy group.

In formula (YII), k represents an integer of 1 or 2 and the substitution position of $R_3$ is preferably the meta position or para position to the acylactamide group.

In Formula (YII), X is preferably a heterocyclic group bonded to the coupling active site via a nitrogen atom, or an aryloxy group.

When X represents a heterocyclic group, X is preferably a 5- to 7-membered monocyclic or condensed heterocyclic ring which may be substituted. Examples include succinimide, maleimide, phthalimide, diglycolimide, pyrrole, pyrazole, imidazole, 1,2,4-triazole, tetrazole, indole, indazole, benimidazole, benzotriazole, imidazolidine-2,4-dione, oxazolidine-2,4-dione, thiazolidine-2,4-dione, imidazolidine-2-one, oxazolidine-2-one, thiazolidine-2-one, benzimidazoline-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, 2-pyrazone, 2-amino-l,3,4-thiazolidine, and 2-imino-1,3,4-thiazolidine-4-one. These heterocyclic rings may be substituted.

Suitable examples of substituents for these heterocyclic rings include, a halogen atom, a hydroxyl group, a nitro group, a cyano group, a carboxyl group, a sulfo group, an alkyl group, an aryl group, an alkoxy group, an aryloxy group, an alkylthio group, an arylthio group, an alkylsulfonyl group, an arylsulfonyl group, an alkoxycarbonyl group, an aryloxycarbonyl group, an acyl group, an acyloxy group, an amino group, a carbonamide group, a sulfonamide group, a carbamoyl group, a sulfamoyl group, a ureido group, an alkoxycarbonylamino group, and a sulfamoylamino group.

When X represents an aryloxy group, X is preferably an aryloxy group having a C number of 6 to 30 and may be substituted with the groups selected from the group of substituents enumerated above for X which is a heterocyclic ring. Preferred substituents for the aryloxy group are a halogen atom, a cyano group, a nitro group, a carboxyl group, a trifluoromethyl group, an alkoxycarbonyl group, a carbonamide group, a sulfonamide group, a carbamoyl group, a sulfamoyl group, an alkylsulfonyl group, an arylsulfonyl group, and a cyano group.

Substituents particularly preferably used in Formula (YII) are explained below.

$R_1$ is particularly preferably an alkyl group having a C number of 1 to 30 (for example, methyl, ethyl, n-propyl, n-butyl, isobutyl, n-octyl, n-dodecyl, phenoxymethyl, phenylthiomethyl, p-toluenesulfonylmethyl, benzyl, cyclohexylmethyl, and methoxyethyl), and most preferably an alkyl group having a C number of 1 to 4.

Q is particularly preferably a group of nonmetal atoms which form a 3- to 5-membered hydrocarbon ring together with C and, for example, an ethylene group, a trimethylene group or a tetramethylene group each of which may be substituted. Suitable substituents are an alkyl group, an alkoxy group, an aryl group, and a halogen atom.

Q is most preferably a substituted or unsubstituted ethylene group.

$R_2$ is particularly preferably a chlorine atom, a fluorine atom, an alkyl group having a C number of 1 to 6 (for example, methyl, trifluoromethyl, ethyl, isopropyl, and t-butyl), an alkoxy group having a C number of 1 to 8 (for example, methoxy, ethoxy, ethoxymethoxy, butoxy, and hexadecyloxy), or an aryloxy group having a C number of 6 to 24 (for example, phenoxy, p-tolyloxy, and p-methoxyphenoxy), and most preferably a chlorine atom, methoxy or trifluoromethyl.

$R_3$ is particularly preferably a halogen atom, a cyano group, a trifluoromethyl group, an alkoxy group, an alkoxycarbonyl group, an aryloxycarbonyl group, a carbonamide group, a sulfonamide group, a carbamoyl group, or a sulfamoyl group, and most preferably a chlorine atom, an alkoxy group, an alkoxycarbonyl group, a sulfamoyl group, a carbonamide group, or a sulfonamide group.

X is particularly preferably a group represented by the following Formula (Y-1), (Y-2) or (Y-3):

Formula (Y-2)

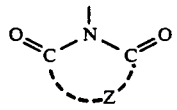

-continued

Formula (Y-2)

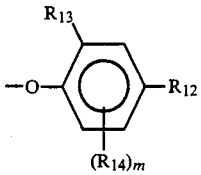

Formula (Y-3)

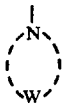

In Formula (Y-1), Z represents —O—$CR_4'(R_5')$—, —S—$CR_4'(R_5')$—, —$NR_6'$—$CR_4'(R_5')$—, —$NR_6'$—$NR_7'$—, or —$CR_4'(R_5')$—$CR_8'(R_9')$—, wherein $R_4'$, $R_5$, $R_8'$ and $R_9'$ each represent a hydrogen atom, an alkyl group, an aryl group, an alkoxy group, an aryloxy group, an alkylthio group, an arylthio group, an alkylsulfonyl group, an arylsulfonyl group, or an amino group; $R_6'$ and $R_7'$ each represent a hydrogen atom, an alkyl group, an aryl group, an alkylsulfonyl group, an arylsulfonyl group, or an alkoxycarbonyl group; $R_{10}'$ and $R_{11}'$ each represent a hydrogen atom, an alkyl group, or an aryl group; $R_{10}'$ and $R_{11}'$ may combine with each other to form a benzene ring; and $R_4'$ and $R_5'$, $R_5'$ and $R_6'$, $R_6'$ and $R_7'$, or $R_4$ and $R_8'$ may combine with each other to form a ring (for example, cyclobutane, cyclohexane, cycloheptane, cyclohexene, pyrroridine, and piperidine).

Of the heterocyclic groups represented by Formula (Y-1), particularly preferred is a heterocyclic group in which Z in Formula (Y-1) is —O—$CR_4'(R_5')'$, —$NR_6'$—$CR_4'(R_5')$—, or —$NR_6'$—$NR_7$+—. The C number of the heterocyclic group represented by Formula (Y-1) is 2 to 30, preferably 4 to 20, and more preferably 5 to 16.

In Formula (Y-2), at least one of $R_{12}$ and $R_{13}$ is selected from a halogen atom, a cyano group, a nitro group, a trifluoromethyl group, a carboxyl group, an alkoxycarbonyl group, an carbonamide group, a sulfonamide group, a carbamoyl group, a sulfamoyl group, an alkylsulfonyl group, an arylsulfonyl group, and an acyl group, and the other may be a hydrogen atom, an alkyl group or an alkoxy group. $R_{14}$ represents the same group as that defined for $R_{12}$ or $R_{13}$ and m represents 0 or an integer of 1 to 2. The C number of the aryloxy group represented by Formula (Y-2) is 6 to 30, preferably 6 to 24, and more preferably 6 to 15.

In Formula (Y-3), W represents a group of non-metal atoms necessary to form a pyrrole ring, a pyrazole ring, an imidazole ring, or a triazole ring together with N. The ring represented by Formula (Y-3) may have a substituent and preferred examples of suitable substituents are a halogen atom, a nitro group, a cyano group, an alkoxycarbonyl group, an alkyl group, an aryl group, an amino group, an alkoxy group, an aryloxy group, and a carbamoyl group. The C number of the heterocyclic group represented by Formula (Y-3) is 2 to 30, preferably 2 to 24, and more preferably 2 to 16.

X is most preferably the group represented by Formula (Y-1).

The couplers represented by Formula (YII) may form a dimer or polymer in which they are bonded to each other via a bond or a two or more valent group in the substituents $R_1$, $R_2$, $R_3$, Q, or x. In this case, the number of carbon atoms may fall out of the ranges shown above for the respective groups.

Specific examples of the yellow couplers represented by Formula (YII) are shown below but the invention is not to be constructed as limited to these couplers.

Y-1

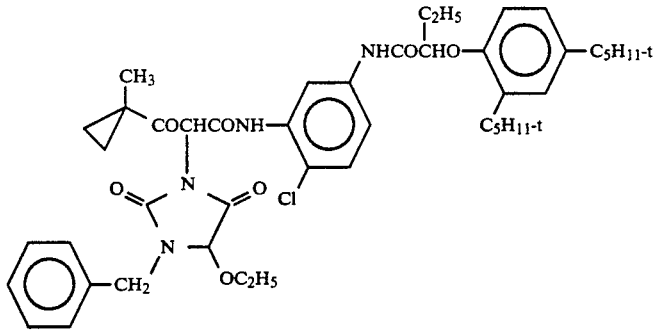

Y-2

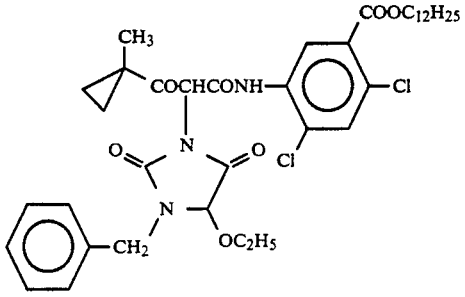

-continued
Y-3
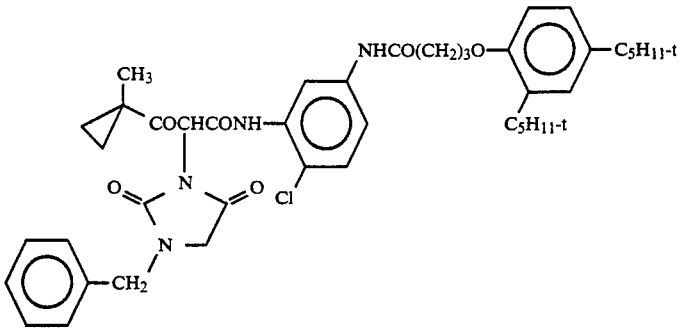
Y-4
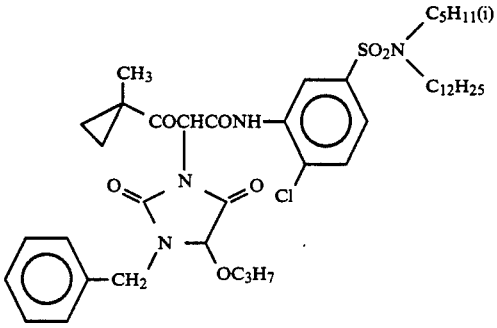
Y-5
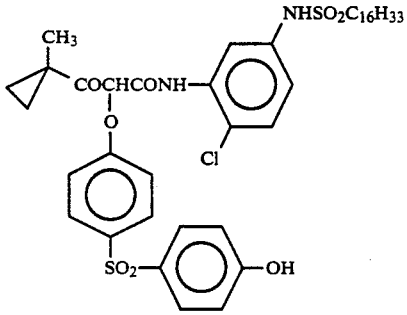
Y-6
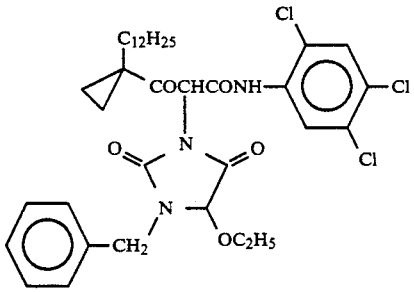
Y-7
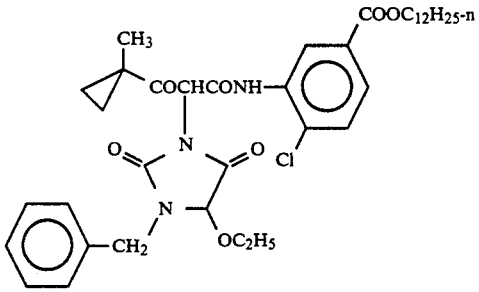
Y-8
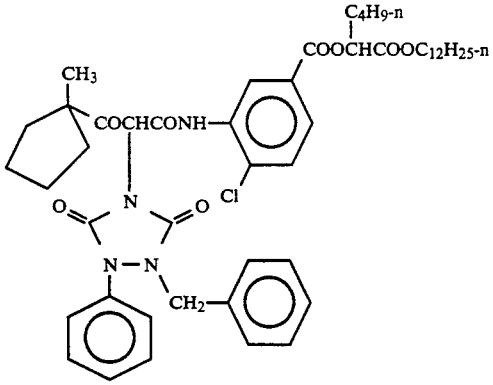
Y-9
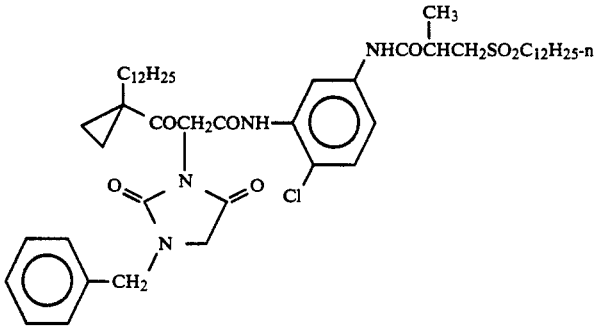

-continued
Y-10
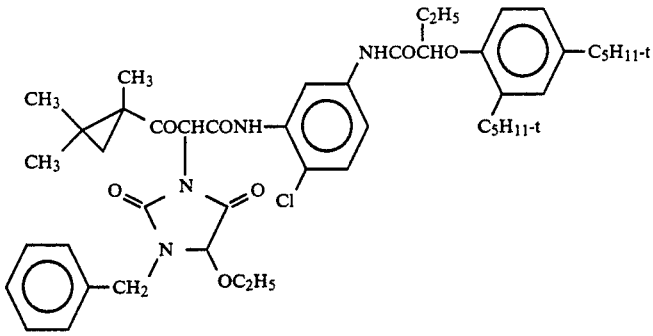
Y-11
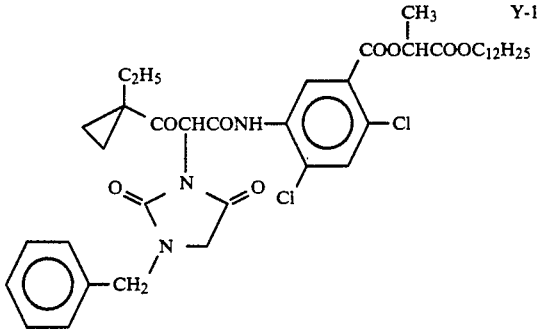
Y-12
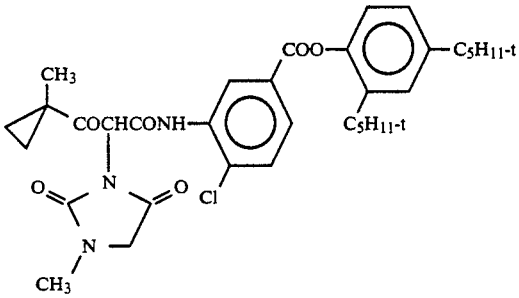
Y-13
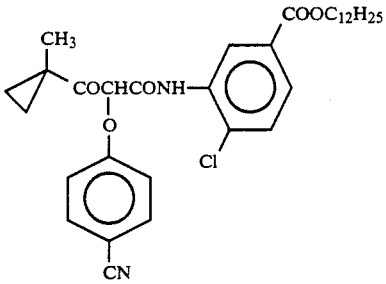
Y-14
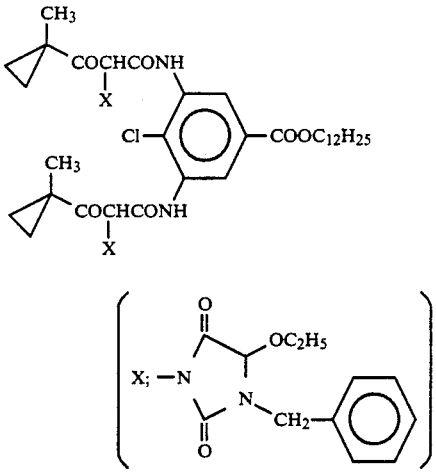
Y-15
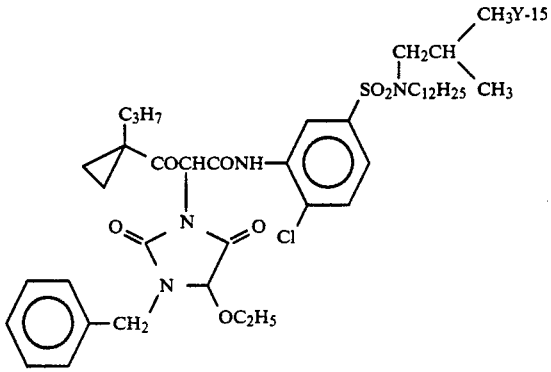
Y-16
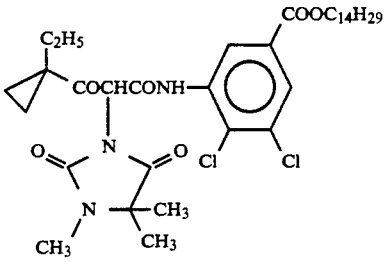

-continued
Y-17
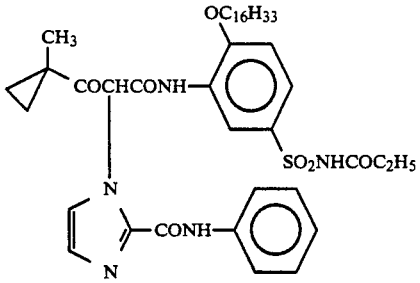
Y-18
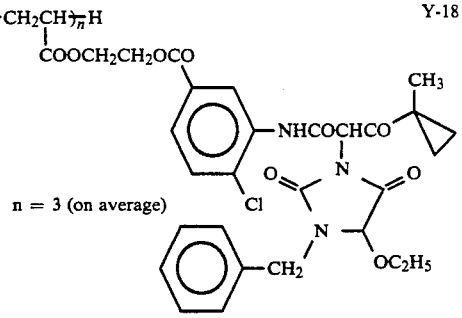
n = 3 (on average)
Y-19
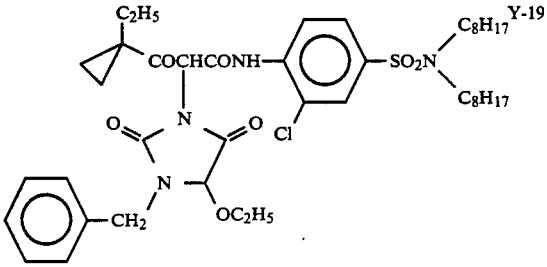
Y-20
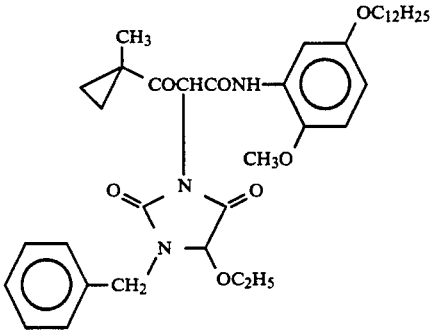
Y-21
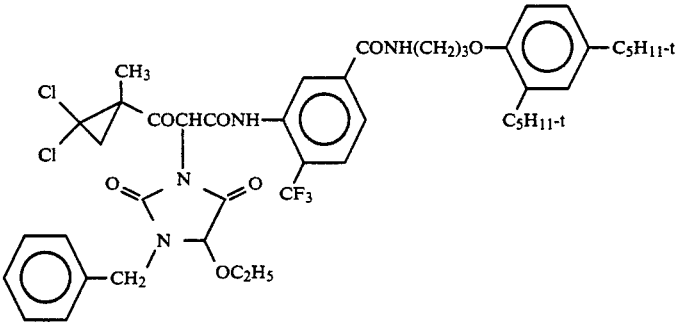
Y-22
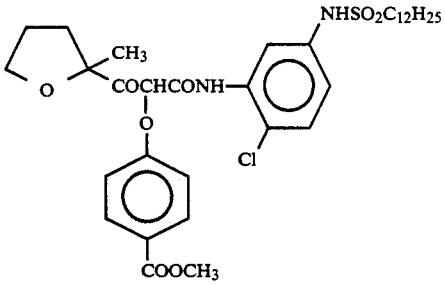
Y-23
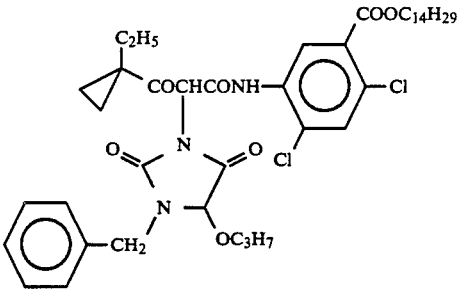
Y-24
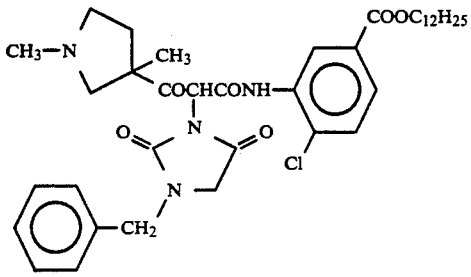
Y-25
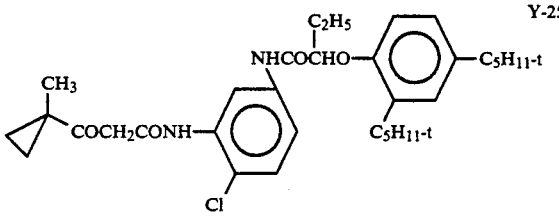

-continued

Y-26

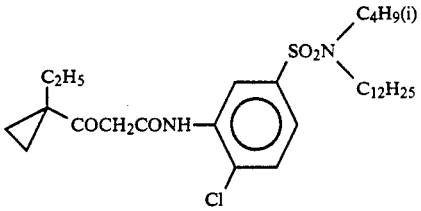

Y-27

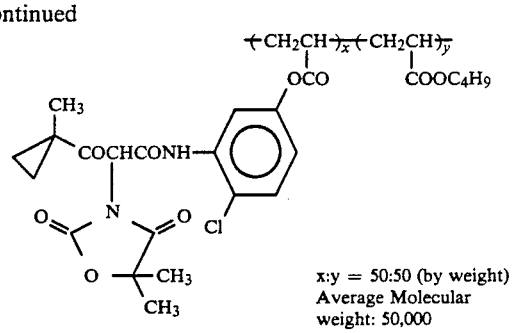

x:y = 50:50 (by weight)
Average Molecular weight: 50,000

Y-28

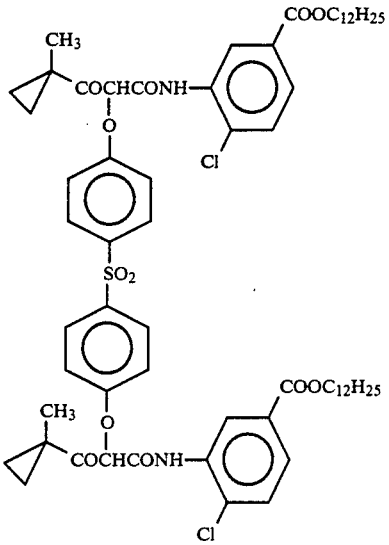

Y-29

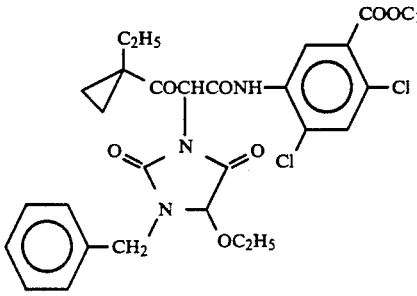

Y-30

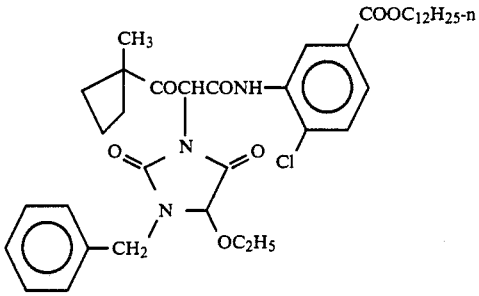

Y-31

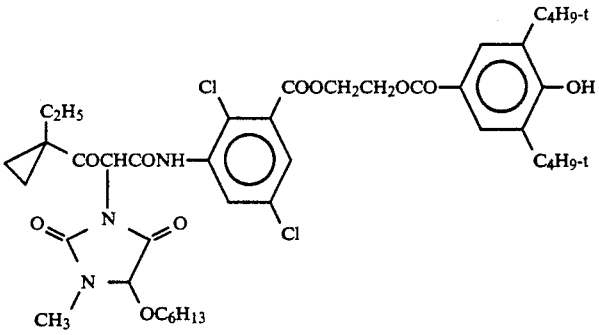

The yellow coupler represented by Formula (YII) can be synthesized using conventional synthetic methods, for example, the method described in European Patent Application (EP) 447 969 A.

The yellow coupler represented by Formula (YII) can be used in any layer of light-sensitive materials. That is, it can be used in any light-sensitive layer (for example, a blue-sensitive layer, a green-sensitive layer and a red-sensitive layer) and a non-sensitive layer (for example, a protective layer, a yellow filter layer, an intermediate layer, and an anti-halation layer). It is used preferably in a blue-sensitive layer or non-sensitive layer adjacent thereto.

A preferred amount of the coupler represented by Formula (YII) is 0.05 to 5.0 mmol/$m^2$, more preferably 0.1 to 2.0 mmol/$m^2$.

Where the coupler represented by Formula (YII) is used in a light-sensitive layer, a preferred mole ratio of the coupler to silver halide is within the range of 1:0.1 to 1:200, more preferably 1:2 to 1:150. Where it is used in a non-light-sensitive layer, the mole ratio thereof to silver halide present in an adjacent silver halide emulsion layer is preferably 1:2 to 1:200.

The coupler represented by Formula (YII) may be used alone or in combination with other yellow couplers (for example, benzoyl acetanilide yellow couplers and pivaloyl acetanilide yellow couplers) as long as the objects of the present invention are not adversely affected.

The techniques and inorganic and organic materials which can be used in color photographic light-sensitive materials are described in the following portions in European Patent 436,938A2 and the patents cited below:

1. Layer construction: pp. 146, line 34 to pp. 147, line 25.
2. Silver Halide Emulsion: pp. 147, line 26 to pp. 148, line 12.
3. Yellow Couplers: pp. 137, line 35 to pp. 146, line 33 and pp. 149, lines 21 to 23.
4. Magenta Couplers: pp. 149, lines 24 to 28; pp. 3, line 5 to pp. 25, line 55 of European Patent 421,453Al.
5. Cyan Couplers: pp. 149, lines 29 to 33; pp. 3, line 28 to pp. 40, line 2 of European Patent 432,804A2.
6. Polymer Couplers: pp. 149, lines 34 to 38; pp. 113, line 39 to pp. 123, line 37 of European Patent 435,334A2.
7. Colored Couplers: pp. 53, line 42 to pp. 137, line 34 and pp. 149, lines 39 to 45.
8. Other Functional Couplers: pp. 7, line 1 to pp. 53, line 41 and pp. 149, line 46 to pp. 150, line 3; pp. 3, line 1 to pp. 29, line 50 of European Patent 435,334A2.
9. Fungicides & Anti-Mold Agents: pp. 150, lines 25 to 28.
10. Formaldehyde Scavengers: pp. 149, lines 15 to 17.
11. Other Additives: pp. 153, lines 38 to 47; pp. 75, line 21 to pp. 84, line 56 and pp. 27, line 40 to pp. 37, line 40 of European Patent 421,453A1.
12. Dispersing Methods: pp. 150, lines 4 to 24.
13. Supports: pp. 150, lines 32 to 34.
14. Layer Thicknesss & Layer Physical Properties: pp. 150, lines 35 to 49.
15. Color Developing Steps: pp. 150, line 50 to pp. 151, line 47.
16. Desilvering Steps: pp. 151, line 48 to pp. 152, line 53.
17. Automatic Developing Machines: pp. 152, line 54 to pp. 153, line 2.
18. Rinsing & Stabilizing Steps: pp. 153, lines 3 to 37.

Compounds of the Formula (D) are explained below in detail. In Formula (D) , $R_4$ represents a linear or branched alkyl group having a C number of 1 to 6, or a linear or branched hydroxyalkyl group having a C number of 3 to 6. Specific example thereof include, for example, methyl, ethyl, n-propyl, isopropyl, n-butyl, sec-butyl, n-hexyl, neopentyl, 3 -hydroxypropyl, 4-hydroxybutyl, 5-hydroxypentyl, 6-hydroxyhexyl, 4-hydroxypentyl, 3-hydroxybutyl, 4-hydroxy-4-methylpentyl, and 5,6-dihydroxyhexyl.

$R_5$ represents a linear or branched alkylene 6, or a linear or group having a C number of 3 to branched hydroxyalkylene group having a C number of 3 to 6. Specific examples thereof, for example, are trimethylene, tetramethylene, pentamethylene, hexamethylene, 1-methylethylene, 2-methylethylene, 1-methyltrimethylene, 2-methyltrimethylene, 3-methyltrimethylene, 3-methylpentamethylene, 2-methylpentamethylene, 2-ethyltrimethylene, and 3-hydroxypentamethylene.

Where $R_4$ is a linear or branched alkyl group in Formula (D), the carbon number thereof is preferably 1 to 4. Of these groups, methyl, ethyl or n-propyl is preferred and ethyl is most preferred. Where $R_4$ is a linear or branched alkyl group having a C number of 1 to 4, $R_5$ is preferably a linear or branched alkylene group having a C number of 3 to 4. Of them, $R_5$ is preferably trimethylene or tetramethylene, most preferably tetramethylene. Meanwhile, where $R_4$ is a linear or branched hydroxyalkyl group having a C number of 3 to 6 in Formula (D), the carbon number of $R_5$ is preferably 4 to 6, more preferably 5 or 6.

In Formula (D), $R_4$ is preferably a linear or branched alkyl group having a C number of 1 to 4.

$R_6$ represents a hydrogen atom, a linear or branched alkyl group having a C number of 1 to 4, or a linear or branched alkyloxy group having a C number of 1 to 4. Specific examples of $R_6$ , for example, are hydrogen, methyl, ethyl, n-propyl, isopropyl, sec-butyl, methoxy, ethoxy, and isopropoxy. $R_6$ is preferably an alklyl group. Of these groups, $R_6$ is preferably methyl or ethyl, most preferably methyl.

Specific examples of representative developing agents represented by Formula (D) useful in the present invention are shown below but the present invention is not to be construed as being limited thereby.

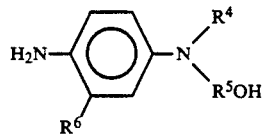

(D)

| Compound No. | $R^4$ | $R^5$ | $R^6$ |
|---|---|---|---|
| D-1 | $-CH_3$ | $-(CH_2)_3-$ | $-CH_3$ |
| D-2 | $-C_2H_5$ | $-(CH_2)_3-$ | $-CH_3$ |
| D-3 | $-C_2H_5$ | $-CH_2CH(CH_3)-$ | $-CH_3$ |

-continued (D)

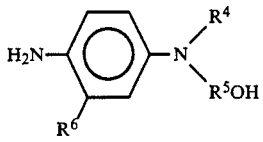

| Compound No. | $R^4$ | $R^5$ | $R^6$ |
|---|---|---|---|
| D-4 | $-C_2H_5$ | $-CH(CH_3)-CH_2-$ | $-CH_3$ |
| D-5 | $-CH_3$ | $-(CH_2)_3-$ | $-C_2H_5$ |
| D-6 | $-C_2H_5$ | $-(CH_2)_3-$ | $-C_2H_5$ |
| D-7 | $-C_3H_7(n)$ | $-(CH_2)_3-$ | $-CH_3$ |
| D-8 | $-CH_3$ | $-(CH_2)_3-$ | $-C_3H_7(n)$ |
| D-9 | $-CH_3$ | $-(CH_2)_3-$ | $-C_4H_9(n)$ |
| D-10 | $-C_4H_9(n)$ | $-(CH_2)_3-$ | $-CH_3$ |
| D-11 | $-C_3H_7(n)$ | $-(CH_2)_4-$ | $-CH_3$ |
| D-12 | $-C_2H_5$ | $-(CH_2)_4-$ | $-CH_3$ |
| D-13 | $-CH_3$ | $-CH_2CH(CH_3)CH_2-$ | $-C_2H_5$ |
| D-14 | $-C_2H_5$ | $-CH_2CH_2CH(CH_3)-$ | $-C_2H_5$ |
| D-15 | $-C_2H_5$ | $-CH_2CH(CH_3)CH_2-$ | $-CH_3$ |
| D-16 | $-C_2H_5$ | $-CH_2CH_2CH(CH_3)-$ | $-CH_3$ |
| D-17 | $-C_2H_5$ | $-(CH_2)_6-$ | $-CH_3$ |
| D-18 | $-(CH_2)_4OH$ | $-(CH_2)_4$ | $-CH_3$ |
| D-19 | $-(CH_2)_3OH$ | $-(CH_2)_3-$ | $-C_2H_5$ |
| D-20 | $-(CH_2)_5OH$ | $-(CH_2)_5-$ | $-CH_3$ |
| D-21 | $-(CH_2)_5OH$ | $-(CH_2)_6-$ | $-CH_3$ |
| D-22 | $-(CH_2)_5OH$ | $-(CH_2)_5-$ | $-C_2H_5$ |
| D-23 | $-(CH_2)_4OH$ | $-(CH_2)_5-$ | $-C_3H_7(i)$ |
| D-24 | $-(CH_2)_5OH$ | $-(CH_2)_3-CH(CH_3)-$ | $-CH_3$ |
| D-25 | $-C_3H_7(n)$ | $-(CH_2)_3-CH(CH_3)CH_2-$ | $-C_2H_5$ |
| D-26 | $-CH_2CH_2CH(CH_3)CH_2CH_3$ | $-(CH_2)_5-$ | $-CH_3$ |
| D-27 | $-CH_2CH(OH)C_2H_5$ | $-(CH_2)_4-$ | $-C_2H_5$ |
| D-28 | $-(CH_2)_4OH$ | $-(CH_2)_4-$ | $-C_4H_9(t)$ |
| D-29 | $-C_2H_5$ | $-(CH_2)_3-$ | H |
| D-30 | $-C_2H_5$ | $-(CH_2)_4-$ | $-OCH_3$ |
| D-31 | $-(CH_2)_5OH$ | $-(CH_2)_5-$ | $-OC_2H_5$ |
| D-32 | $-CH_2CH_2CH(OH)C_2H_5$ | $-(CH_2)_5-$ | H |
| D-33 | $-C_3H_7(n)$ | $-(CH_2)_4-$ | H |
| D-34 | $-(CH_2)_4OH$ | $-(CH_2)_4-$ | $-OC_3H_7(i)$ |
| D-35 | $-(CH_2)_5OH$ | $-(CH_2)_6-$ | H |
| D-36 | $-CH_3$ | $-(CH_2)_3-$ | $-OC_4H_9(t)$ |

Of the compounds represented by Formula (D), compounds D-2, D-12 and D-20 are preferred and compound D-12 is most preferred.

Next, $R_{11}$, n, $R_{12}$ and m in the compound represented by Formula (E) are explained in detail below.

$R_{11}$ is a substituent and in greater detail, $R_{11}$ represents a halogen atom, an alkyl group, an aryl group, a heterocyclic group, a cyano group, a nitro group, a hydroxyl group, a carboxyl group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamide group, a carbamoyl group, a sulfamoyl group, a sulfamoyl group, an alkoxycarbonyl group, a heterocyclicoxy group, an azo group, an acyloxy group, a carbamoyloxy group, a silyl group, a silyloxy group, an aryloxycarbonylamino group, an imide group, a heterocyclicthio group, a sulfinyl group, a phosphonyl group, an aryloxycarbonyl group, or an acyl group.

Examples of substituents for $R_{11}$ are described in greater detail below. The halogen atom can be, for example, a fluorine atom or a chlorine atom. The alkyl group can be a linear, branched or cyclic alkyl group having a C number of 1 to 16, preferably 1 to 6, and may be substituted with an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Examples include, methyl, ethyl, propyl, isopropyl, t-butyl, 2-hydroxyethyl, 3-hydroxypropyl, benzyl, 2-methanesulfonamidethyl, 3-methanesulfonamidepropyl, 2-methanesulfonylethyl, 2-methoxyethyl, cyclopentyl, 2-acetamidethyl, 2-carboxyethyl, 2-carbamoylethyl, 3-carbamoylpropyl, n-hexyl, 2-hydroxypropyl, 4-hydroxybutyl, 2-carbamoylaminoethyl, 3-carbamoylaminopropyl, 4-carbamoylaminobutyl, 4-carbamoylbutyl, 2-carbamoyl-1-methylethyl, or 4-nitrobutyl.

The aryl group can be an aryl group having a C number of 6 to 24 and may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Examples are phenyl, naphthyl, or p-methoxyphenyl.

The heterocyclic group can be an aromatic or aliphatic 5- or 6-membered heterocylic group having a C number of 1 to 5 and containing one or more of an oxygen atom, a nitrogen atom or a sulfur atom, and the number of a hetero atoms and the kind of elements which constitute the ring may be either the same or different. The heterocyclic group may further be substituted with an alkyl group having a C number of 1 to 16, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Examples include 2-furyl, 2-thienyl, 2-pyrimidinyl, 2-benzotriazolyl, imidazolyl, and pyrazolyl.

The alkoxy group is an alkoxy group having a C number of 1 to 16, preferably 1 to 6, and it may be substituted with an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Examples are methoxy, ethoxy, 2-methoxyethoxy, or 2-methanesulfonylethoxy.

The aryloxy group is an aryloxy group having a C number of 6 to 24 and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. It is, for example, a phenoxy.

The acylamino group is an acylamino group having a C number of 1 to 16, preferably 1 to 6, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Examples are acetamide or 2-methoxypropionamide.

The alkylamino group is an alkylamino group having a C number of 1 to 16, preferably 1 to 6, and it may be substituted with an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Examples are dimethylamino or diethylamino.

The anilino group is an anilino group having a C number of 6 to 24 and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Examples include anilino or m-nitroanilino.

The ureido group is a ureido group having a C number of 1 to 16, preferably 1 to 6, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Examples include methylureido or N,N-diethylureido.

The sulfamoylamino group is a sulfamoylamino group having the C number of 0 to 16, preferably 0 to 6, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. An example is dimethylsulfamoylamino.

The alkylthio group is an alkylthio group having a C number of 1 to 16, preferably 1 to 6, and it may be substituted with an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Typical examples are methylthio or ethylthio.

The arylthio group is an arylthio group having a C number of 6 to 24, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. An example is phenylthio.

The alkoxycarbonylamino group is an alkoxycarbonylamino group having a C number of 2 to 16, preferably 2 to 6, and it may be substituted with an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Examples are methoxycarbonylamino or ethoxycarbonylamino.

The sulfonamide group is a sulfonamide group having a C number of 1 to 16, preferably 1 to 6, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. A typical example is methanesulfonamide.

The carbamoyl group is a carbamoyl group, having a C number of 1 to 16, preferably 1 to 6, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Examples are N,N-dimethylcarbamoyl or N-ethylcarbamoyl.

The sulfamoyl group is a sulfamoyl group having a C number of 0 to 16, preferably 0 to 6, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. An example is N,N-dimethylsulfamoyl.

The sulfonyl group is a sulfonyl group having a C number of 1 to 16, preferably 1 to 6, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Representative examples are methanesulfonyl or ethanesulfonyl.

The alkoxycarbonyl group is an alkoxycarbonyl group having a C number of 1 to 16, preferably 1 to 6, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Examples are methoxycarbonyl or ethoxycarbonyl.

The heterocyclic oxy group is an aromatic or aliphatic 5- or 6-membered heterocylic oxy group having a C number of 1 to 5 and containing one or more of an oxygen atom, a nitrogen atom or a sulfur atom, and the number of hetero atoms and the kind of elements which constitute the ring may be either the same or different. These heterocyclic groups may further be substituted with an alkyl group having a C number of 1 to 16, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Examples are 1-phenyltetrazolyl-5-oxy and 2-tetrahydropyranyloxy.

The azo group is an azo group having a C number of 1 to 16, preferably 1 to 6, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Examples include phenylazo or 2-hydroxy-4-propanoylphenylazo.

The acyloxy group is an acyloxy group having a C number of 1 to 16, preferably 1 to 6, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. An example is acetoxy.

The carbamoyloxy group is a carbamoyloxy group having a C number of 1 to 16, preferably 1 to 6, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. An example is N,N-dimethylcarbamoyloxy.

The silyl group is a silyl group having a C number of 3 to 16, preferably 3 to 6, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. A representative example is trimethylsilyl.

The silyloxy group is a silyloxy group having a C number of 3 to 16, preferably 3 to 6, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. An example is trimethylsilyloxy.

The aryloxycarbonylamino group is an aryloxycarbonylamino group having a C number of 7 to 24 and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. An example is phenoxycarbonylamino.

The imide group is an imide group having a C number of 4 to 16, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. An example is N-succinimide.

The heterocyclic thio group is an aromatic or aliphatic 5- or 6-membered heterocylic thio group having a C number of 1 to 5 and containing one or more of an oxygen atom, a nitrogen atom or a sulfur atom, and the number of hetero atoms and the kind of elements which form the ring may be either the same or different. These heterocyclic groups may further be substituted with an alkyl group having a C number of 1 to 16, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Examples include 2-benzothiazlylthio and 2-pyridylthio.

The sulfinyl group is a sulfinyl group, having a C number of 1 to 16, preferably 1 to 6, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. An example is ethanesulfinyl.

The phosphonyl group is a phosphonyl group having a C number of 2 to 16, preferably 2 to 6, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. An example is methoxyphosphonyl.

The aryloxycarbonyl group is an aryloxycarbonyl group having a C number of 7 to 24 and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. An example is phenoxycarbonyl.

The acyl group is an acyl group having a C number of 1 to 16, preferably 1 to 6, and it may be substituted with an alkyl group, an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Examples include acetyl or benzoyl.

Of these substituents, $R_{11}$ preferably is an alkyl group, a cyano group, a hydroxyl group, a carboxyl group, an alkoxy group, an acylamino group, an alkylamino group, a ureido group, a sulfamoylamino group, an akylthio group, an alkoxycarbonylamino group, an sulfonamide group, a carbamoyl group, a sulfamoyl group, a sulfonyl group, and a carbamoyloxy group. Even more preferred are an alkyl group, a hydroxyl group, an alkoxy group, a ureido group, a sulfamoylamino group, an alkoxycarbonylamino group, a sulfonamide group, a carbamoyl group, and a sulfamoyl group. Particularly preferred are an alkyl group, a hydroxyl group, an alkoxy group, a sulfamoylamino group, a sulfonamide group, and a sulfamoyl group. Preferred as the alkyl group are methyl, ethyl, hydroxymethyl, 2-hydroxyethyl, 3-hydroxypropyl, methanesulfonamidemethyl, and 2-methanesulfonamidethyl.

n represents 0 or an integer of 1 to 8. When n is two or more, the plurality of $R_{11}$ may be the same or different. n is preferably an integer of 1 to 6, more preferably 1 to 4.

$R_{12}$ is a substituent and represents the same groups as those defined above for $R_{11}$.

$R_{12}$ preferably is an alkyl group, an alkoxy group, an alkoxycarbonylamino group, and a ureido group. More preferred is an alkyl group and an alkoxy group, and even further more preferred is an alkyl group. Of the preferred alkyl groups are methyl, ethyl, propyl, isopropyl, t-butyl, 2-hydroxyethyl, 3-hydroxypropyl, 2-methanesulfonamidethyl, 3-methanesulfonamidepropyl, 2-methylsulfonylethyl, 2-methoxyethyl, 2-carbamoylethyl, 3-carbamoylpropyl, 2-hydroxypropyl, 4-hydroxybutyl, 2-carbamoylaminoethyl, 3-carbamoylaminopropyl, 4-carbamoylaminobutyl, 4-carbamoylbutyl, 2-carbamoyl-1-methylethyl, and 4-nitobutyl. Among them, methyl and ethyl are particularly preferred.

m represents 0 or an integer of 1 to 4. When m is two or more, a plurality of $R_{12}$ may be the same or different and may form a ring. When the $R_{12}$'s form a ring, the size of the ring is not specifically limited and it is preferably a 5-membered, 6-membered and 7-membered ring.

It is referred for m to be 0 or 1, and more preferably m is 0 or $R_{12}$ is bonded to the ortho position to the primary amino group on the ring and m is 1. Most preferably $R_{12}$ is bonded to the ortho position to the primary amino group and m is 1 on the ring.

Preferred compounds of the Formula (E) are shown by Formula (F):

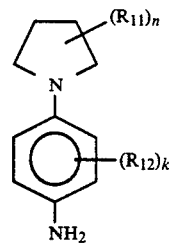

Formula (F)

wherein $R_{11}$, n and $R_{12}$ have the same meaning as above and k is 0 or 1.

Further, of the compounds represented by Formula (E), those represented by Formula (G) are preferred as well:

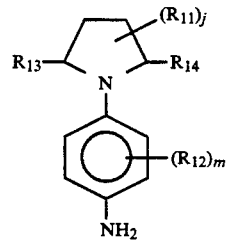

Formula (G)

wherein $R_{11}$, $R_{12}$ and m have the same meaning as in the Formula (E); j represents 0 or an integer of 1 to 6; $R_{13}$ and $R_{14}$ each represent an alkyl group which may be substituted and may be the same as or different from each other.

Formula (G) represents all specific stereoisomers of compounds existing in a stereoisomeric relationship with each other.

The compounds represented by Formula (G) are more preferred than those represented by Formula (F).

j, $R_{13}$ and $R_{14}$ in the compounds represented by Formula (G) are described in detail below.

j represents 0 or an integer of 1 to 6. When j is two or more, the plurality of $R_{11}$ may be the same or different. j is preferably 0 or an integer of 1 to 4, more preferably 0 to 2 and most preferably 0 or 1.

$R_{13}$ and $R_{14}$ each represents an alkyl group which may be substituted. $R_{13}$ and $R_{14}$ may be the same or different. Preferred alkyl groups which may be substituted, are linear, branched or cyclic alkyl groups having a C number of 1 to 16, preferably 1 to 6, and they may be substituted with an alkenyl group, an alkynyl group, an aryl group, a hydroxyl group, a nitro group, a cyano group, a halogen atom, or other substituents formed with an oxygen atom, a nitrogen atom, a sulfur atom, or a carbon atom. Representative examples are methyl, ethyl, propyl, isopropyl, t-butyl, hydroxymethyl, methanesulfonamidomethyl, methoxymethyl, -hydroxyethyl, 3-hydroxypropyl, benzyl, 2-methanesulfonamidoethyl, 2,3-dihydroxypropyl, 3-methanesulfonamidopropyl, 2-methane-sulfonylethyl, 2-methoxyethyl, cyclopentyl, sulfamoyl-methyl, 2-acetamidoethyl, 2-carboxyethyl, 2-carbamoylethyl, 3-carbamoylpropyl, n-hexyl, 2-hydroxypropyl, methylaminosulfamoylaminomethyl, 4-hydroxybutyl, 2-carbamoylaminoethyl, 3-carbamoylaminopropyl, 4-carbamoylaminobutyl, 4-carbamoylbutyl, 2-carbamoyl-1-methylethyl, and 4-nitrobutyl.

Of these groups $R_{13}$ and $R_{14}$ are preferably an unsubstituted alkyl group, a hydroxyalkyl group, an alkoxyalkyl group, a sulfonamidealkyl group, a sulfamoylalkyl group, and a sulfamoylaminoalkyl group. With specific examples being methyl, ethyl, hydroxymethyl, methanesulfonamidomethyl, 2-hydroxyethyl, 3-hydroxypropyl, 2,3-di-hydroxypropyl, 2-sulfamoylethyl, 2-methoxyethyl, and methylaminosulfamoylmethyl. Most preferred for $R_{13}$ and $R_{14}$ is an unsubstituted alkyl group, a hydroxyalkyl group, an alkoxyalkyl group, and a sulfonamidealkyl group.

The compounds represented by the following Formula (H) are particularly preferred compounds of the compound represented by Formula (G):

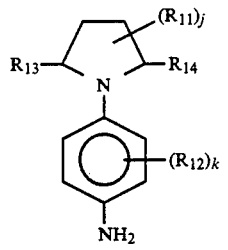

Formula (H)

wherein $R_{11}$, $R_{12}$, $R_{13}$, $R_{14}$ and j have the same meaning as described above and k is 0 or 1.

Specific examples of representative developing agents represented by Formula (E) in the present invention are shown below but the present invention is not to be construed as being limited thereto.

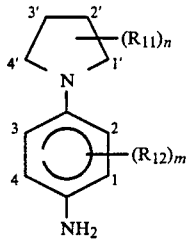

(E)

| Compound No. | $R_{12}$ Position 1- | 2- | 3- | 4- | $R_{11}$ Position 1'- | 2'- | 3'- | 4'- |
|---|---|---|---|---|---|---|---|---|
| E-1 | H | H | H | H | H | $-CH_2OH$ | H | H |
| E-2 | H | H | H | H | H | $-OH$ | H | H |
| E-3 | $-CH_3$ | H | H | H | H | $-CH_2NHSO_2CH_3$ | H | H |
| E-4 | $-CH_3$ | H | H | H | H | $-O(CH_2)_2OH$ | H | H |
| E-5 | $-CH_3$ | H | H | H | H | $-CONH_2$ | H | H |
| E-6 | H | H | H | H | H | $>CH_2OH$ (with $CH_3$) | H | H |
| E-7 | $-CH_3$ | H | H | H | $-CH_2OH$ | H | H | H |
| E-8 | $-CH_3$ | H | H | H | $-CH_2NHSO_2CH_3$ | H | H | H |
| E-9 | $-OCH_3$ | H | H | H | H | H | H | H |
| E-10 | $-CH_2OH$ | H | Cl | H | H | H | H | H |
| E-11 | H | H | H | H | H | $-N(CH_3)_2$ | H | H |
| E-12 | $-OH$ | H | H | H | H | $-CN$ | H | H |
| E-13 | H | $-OCH_3$ | H | H | H | $-NHCOCH_3$ | H | H |
| E-14 | $-C_2H_5$ | H | H | H | H | $-OH$ | H | H |
| E-15 | $-CH_2NHSO_2CH_3$ | H | H | H | H | $-CH_2NHCONH_2$ | H | H |
| E-16 | $-CH_3$ | H | H | H | H | $-NHSO_2CH_3$ | H | H |
| E-17 | $-NHCOOCH_3$ | H | H | H | $-CH_2O(CH_2)_2OH$ | H | H | H |
| E-18 | H | H | H | H | H | $-CH_2OH$ | $-CH_3$ | H |
| E-19 | $-N(CH_3)_2$ | H | H | H | H | $-NHCONH_2$ | H | H |
| E-20 | $-CH_2NHCH_3$ | H | H | H | H | $-(CH_2)_2OH$ | H | H |
| E-21 | $-CH_3$ | H | H | H | H | $-CH_2OH$ | H | H |
| E-22 | $-CH_3$ | H | H | H | H | $-OH$ | H | H |
| E-23 | $-C_2H_5$ | H | H | H | H | $-CH_2CONH_2$ | H | H |
| E-24 | $-CH_2NHCONH_2$ | H | H | H | $-CH_2OH$ | $-CH_3$ | H | H |
| E-25 | $-CH_3$ | H | H | H | H | H | H | H |
| E-26 | $-CH_3$ | H | H | H | H | $-NHCOOCH_3$ | H | H |
| E-27 | $-O(CH_2)_2OH$ | H | H | H | H | $-NHSO_2N(CH_3)_2$ | H | H |
| E-28 | $-C_2H_5$ | H | H | H | H | $-COOH$ | H | H |
| E-29 | $-NHSO_2N(CH_3)_2$ | H | H | H | H | $-OH$ | H | H |
| E-30 | H | H | H | H | H | $-NHSO_2CH_3$ | H | H |
| E-31 | $-C_3H_7(i)$ | H | H | H | $-CH_2OH$ | H | H | $-CH_2OH$ |
| E-32 | $-(CH_2)_2OH$ | H | H | H | $-CH_2OH$ | H | H | $-CH_3$ |
| E-33 | $-(CH_2)_2NHSO_2CH_3$ | H | H | H | $-CH_3$ | $-OH$ | H | $-CH_3$ |
| E-34 | $-C_2H_5$ | H | H | H | $-CH_2OH$ | H | H | $-CH_2OH$ |
| E-35 | $-NHCON(CH_3)_2$ | H | H | H | $-CH_2NHCOCH_3$ | H | H | $-CH_3$ |
| E-36 | $-CH_3$ | H | H | H | $-CH_2NHSO_2CH_3$ | H | H | $-(CH_2)_2OH$ |
| E-37 | $-CH_3$ | H | H | H | $-CH_2OH$ | $-CH_2OH$ | H | $-CH_3$ |
| E-38 | $-CH_3$ | H | H | H | $-CH_3$ | $-CH_2OCH_3$ | H | $-CH_2OH$ |

-continued

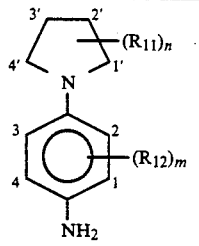

(E)

| Compound No. | $R_{12}$ Position 1- | 2- | 3- | 4- | $R_{11}$ Position 1'- | 2'- | 3'- | 4'- |
|---|---|---|---|---|---|---|---|---|
| E-39 | $-CH_3$ | H | H | H | $-(CH_2)_2OH$ | H | H | $-CH_2OCH_3$ |
| E-40 | $-C_2H_5$ | H | H | H | $-(CH_2)_2OH$ | H | H | $-(CH_2)_2OH$ |
| E-41 | H | H | H | H | $-(CH_2)_3OH$ | H | H | $-(CH_2)_2OCH_3$ |
| E-42 | $-CH_3$ | H | H | H | $-CH_2NHCONH_2$ | H | H | $-CH_3$ |
| E-43 | $-CH_3$ | H | H | H | $-CH_3$ | H | H | $-CH_3$ |
| E-44 | $-CH_3$ | H | H | H | $-CH_2OH$ | H | H | $-CH_2OH$ |
| E-45 | H | H | H | H | $-CH_3$ | $-OH$ | H | $-CH_3$ |
| E-46 | $-OCH_3$ | H | H | H | $-CH_3$ | $-CH_2OH$ | H | $-CH_2OH$ |
| E-47 | H | $-OCH_3$ | H | H | $-CH_2NHSO_2CH_3$ | H | H | $-CH_3$ |
| E-48 | $-NHSO_2N(CH_3)_2$ | H | H | H | $-CH_3$ | $CH_3$ / \ OH | H | $-CH_3$ |
| E-49 | $-OCH_3$ | H | Cl | H | $-CH_2OH$ | H | H | $-CH_3$ |
| E-50 | $-NHCOCH_3$ | H | H | H | $-CH_2CONH_2$ | H | H | $-CH_3$ |

The compounds represented by Formula (D) are preferred to the compounds represented by Formula (E).

Where the compounds represented by Formula (D) or (E) are stored in the form of a free amine, they are quite unstable. As a result they are preferably produced and stored in the form of an inorganic acid or organic acid salt and they are preferably converted to a free amine immediately after they are added to a processing solution. Examples of inorganic and organic acids which can be used to produce salts with the compounds of Formula (D) or (E) are for example, hydrochloric acid, sulfuric acid, phosphoric acid, p-toluenesulfonic acid, methanesulfonic acid, and naphthalene-1,5-disulfonic acid. Of these acid salts, the salts of sulfuric acid and p-toluenesulfonic acid are preferred and the salt of sulfuric acid is most preferred. For example, compound D-12 can be obtained in the form of a sulfuric acid salt and the melting point thereof is 112° to 114° C. (recrystallized from ethanol).

The amount of the color developing agent of the present invention is preferably 0.3 to 100 mmole, more preferably 3 to 70 mmole, per liter of a developing solution.

Where the developing agent of the present invention is used as a combination of two or more thereof the whole amount thereof used is preferably 0.3 to 200 mmole, more preferably 3 to 150 mmole, per liter of a developing solution.

A processing temperature used in the developing solution is 20° to 50° C., preferably 30° to 45° C.

The developing agent of the present invention can be readily synthesized according to the methods described in, for example, *Journal of the American Chemical Society*, vol. 73, pp. 3100 (1951), British Patent 807,899, and JP-A-4-11255.

Further, the following synthetic examples and methods according thereto can be used as well. Unless otherwise indicated herein, all parts, percentages, ratios and the like are by weight.

SYNTHETIC EXAMPLE 1

Synthesis of Compound E-43

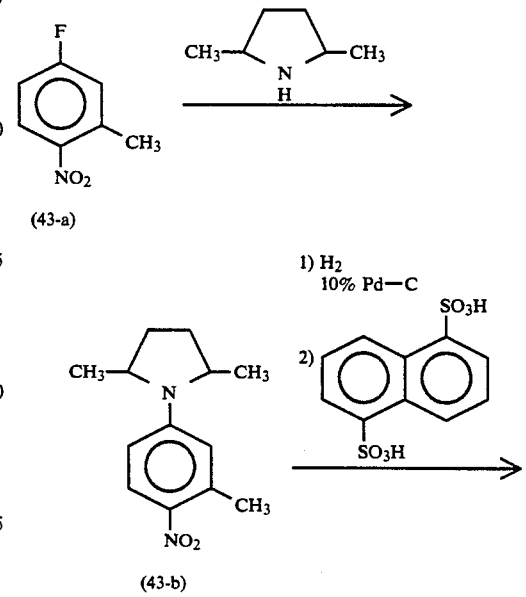

-continued

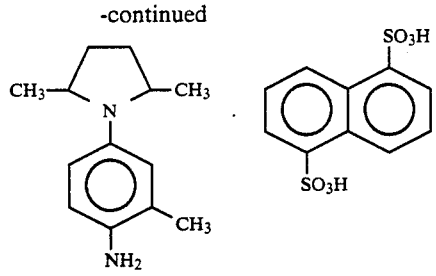

(E-43)

1,5-naphthalene disulfonic acid salt of Compound (E-43)

I

Synthesis of (43-b)

0.80 g of (43-a) and 0.51 g of 3-dimethylpyrrolidine were added to 3.2 ml of dimethylformamide together with 0.78 g of potassium carbonate and stirred at 100° C. for 6 hours. After allowing the mixture to cool the solution was poured into water and extracted with ethyl acetate, followed by purification with silica gel column chromatography after washing and concentrating, whereby 0.70 g of (43-b) was obtained in the form of a yellow oily substance.

Synthesis of Compound (E-43)

0.70 g of (43-b) and 0.1 g of 10% palladium, on carbon were added to 10 ml of ethanol and stirred in an autoclave at a hydrogen pressure of 50 kg/m$^2$ and an internal temperature of 50° C. for two hours. After filtering off the catalyst, the filtrate was dropped into an ethanol solution of 1.08 g of 1,5-naphthalenedisulfonic acid 4 hydrate and the crystals deposited were filtered, whereby 1.36 g of the 1,5-naphthalenedisulfonic acid salt of Compound (E-43) was obtained in the form of white crystals.

| Elemental analysis as $C_{23}H_{28}N_2O_6S_2$ | | | | |
|---|---|---|---|---|
| | C | H | N | S |
| Calculated | 56.08 | 5.73 | 5.69 | 13.02 |
| obtained | 55.83 | 5.70 | 5.45 | 12.98 |

The color developing agent of the present invention is advantageously used alone or in combination with the other conventionally known p-phenylenediamine derivatives. Representative examples of these compounds which can be used in combination are shown below but the invention is not limited thereto.

P-1 N, N-diethyl-p-phenylenediamine
P-2 2-amino-5-(N,N-diethylamino) toluene
P-3 2-amino-5-(N-ethyl-N-laurylamino) toluene
P-4 4-[N-ethyl-N-(β-hydroxyethyl) amino]aniline
P-5 2-methyl-4-[N-ethyl-N-(β-hydroxyethyl) amino]aniline
P-6 4-amino-3-methyl-N-ethyl-N-[β-(methanesulfonamide) ethyl]aniline
P-7 N-(2-amino-5-N,N-diethylaminophenylethyl) methanesulfonamide
P-8 N,N-dimethyl-p-phenylenediamine
P-9 4-amino-3-methyl-N-ethyl-N-methoxyethylaniline
P-10 4-amino-3-methyl-N-ethyl-N-β-ethoxyethylaniline
P-11 4 -amino- 3-methyl-N-ethyl-N-β-butoxyethylaniline Of the above described p-phenylenediamine derivatives, particularly preferred as a compound to be used in combination is compound P-5 or P-6. These p-phenylenediamine derivatives are usually used in the form of a sulfuric acid salt, a hydrochloric acid salt, a sulfurous acid salt, a p-toluenesulfonic acid salt, a nitric acid salt, and a naphthalene-1,5-disulfonic acid salt. The agent to be used in combination is used preferably in the amount of 1/10 to 10 mole per mole of the developing agent used in the present invention as long as the effects of the present invention are not adversity affected.

The color developing solution used in the present invention is usually alkaline and is preferably an alkaline aqueous solution of a pH of 9 to 12.5.

In general, the color developing solution contains a pH buffer agent such as a carbonate, borate or phosphate of an alkali metal, and a developing inhibitor or an antifogging agent such as bromide, iodide, a benzimidazole, a benzothiazole or a mercapto compound. Further, as desired various preservatives such as hydroxylamine, diethylhydroxylamine, sulfite, hydrazines, phenylsemicarbazides, triethanolamine, cathecolsulfonic acids, and triethylenediamine (1,4-diazabicyclo[2,2,-21octanes), an organic solvent such as ethylene glycol and diethylene glycol, a developing accelerator such as benzyl alcohol, polyethylene glycol, a quaternary ammonium salt, an amine, a dye-forming coupler, a competitive coupler, a fogging agent such as sodium boron hydride, an auxiliary developing agent such as 1-phenyl-3-pyrazolidone, and a tackifier can be present. Further, various chelating agents represented by aminopolycarboxylic acids, aminopoly-phosphonic acids, alkylphosphonic acids, and phosphono-carboxylic acids, can also be present and representative example thereof include ethylene-diaminetetracetic acid, nitrilotriacetic acid, diethylenetriaminepentacetic acid, cyclohexanediaminetetracetic acid, hyroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediaminedi(o-hydroxyphenylacetic acid), and the salts thereof.

In the method of the present invention, conventional techniques can be used for color development. The detail thereof are described in the above European Patent EP 436 938 A.

Further, bleaching, fixing, rinsing and/or stabilizing processings can be carried out after the color development. The details of these steps are also described in the above European patent.

The method of the present invention improves image fastness in light irradiation and processing rapidity as well as color development and image fastness on storage in the dark to a large extent.

These effects are notable in a color light-sensitive material, particularly in a light-sensitive material for photographing, in which particularly a silver bromoiodide or silver bromochloroiodide emulsion is used.

EXAMPLES

The present invention is explained below in greater detail by reference to the following examples but the invention is not limited thereto.

The following compounds were used as a comparative coupler.

[YC-1]

-continued

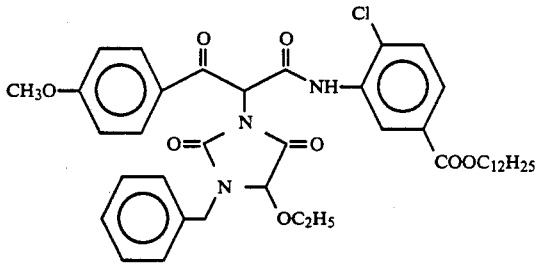

(decsribed in Research Disclosure-180531)

[YC-2]

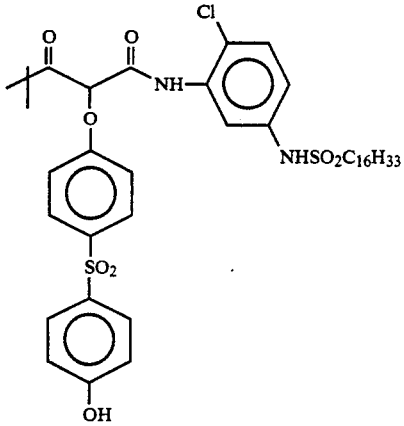

(described in U.S. Pat. No. 3,933,501)

[YC-3]

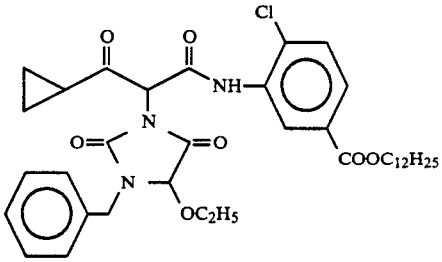

(described in JP-A-47-26133)

EXAMPLE 1

Two layers having the following compositions were coated on a subbed cellulose triacetate film and a yellow coupler (ExY) was replaced in an equimolar amount, whereby color light-sensitive materials for an evaluation were prepared.

Composition of Light-Sensitive Layer

The numerals corresponding to the respective components represent the coated amounts expressed in terms of a g/m$^2$, provided that ExY is shown as mmole/m$^2$ and the sensitizing dye by the coated amount in terms of mole per mole of silver halide present in the same layer.

| | |
|---|---|
| First Layer (a blue-sensitive emulsion layer) | |
| Silver bromoiodide emulsion<br>Average AgI content: 8.6%<br>Average grain size: 0.71 μm<br>(a variation coefficient: 16%)<br>core/shell = 3/7 double structure grain (AgI content = 24%/2%) | silver 0.41 |

-continued

| | |
|---|---|
| Sensitizing dye VII | $3.4 \times 10^{-4}$ |
| ExY | 1.00 (mmol) |
| HBS-1 | 0.30 |
| W-1 | 0.10 |
| F-1 | 0.004 |
| B-5 | 0.014 |
| B-4 | 0.010 |
| Gelatin | 2.00 |
| Second Layer (a protective layer) | |
| H-1 | 0.18 |
| W-2 | 0.10 |
| B-4 | 0.01 |
| B-1 (diameter: 1.7μ) | 0.05 |
| B-2 (diameter: 1.7μ) | 0.10 |
| B-3 | 0.10 |
| Gelatin | 1.20 |

The following compounds were used in these layers.

HBS-1

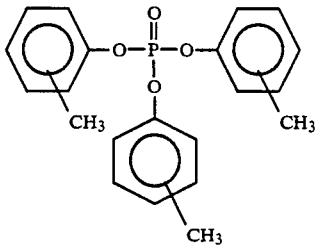

W-1

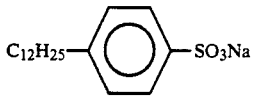

W-2

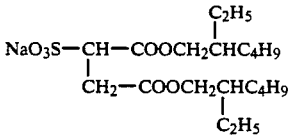

F-1

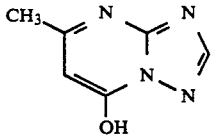

B-5

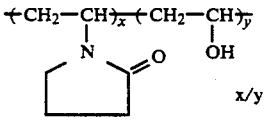

x/y = 70/30

B-4

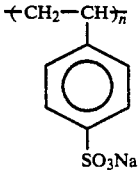

B-1

-continued

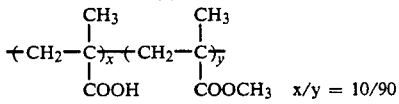

x/y = 10/90

B-2

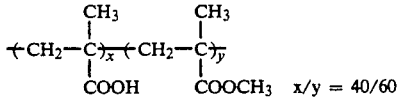

x/y = 40/60

B-3

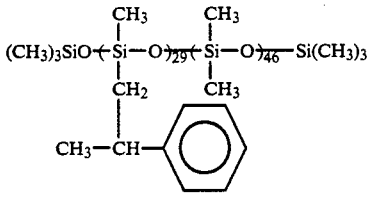

H-1

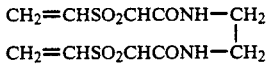

Sensitizing Dye VII

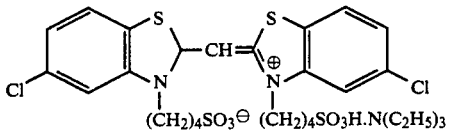

These color light-sensitive materials were subjected to an imagewise exposure via an optical wedge and then to the following processings:

| Processing Steps | | |
|---|---|---|
| Step | Time | Temperature |
| Color Developing | 2 minutes & 15 seconds | 38° C. |
| Bleaching | 6 minutes & 30 seconds | 38° C. |
| Rinsing | 2 minutes & 10 seconds | 24° C. |
| Fixing | 4 minutes & 20 seconds | 38° C. |
| Rinsing (1) | 1 minute & 5 seconds | 24° C. |
| Rinsing (2) | 1 minute | 24° C. |
| Stabilizing | 4 minutes & 5 seconds | 38° C. |
| Drying | 4 minutes & 20 seconds | 55° C. |

The compositions of the processing solutions used were as follows:

| | (Unit: g) |
|---|---|
| Color Developing Solution | |
| Diethylenetriaminepentacetic acid | 1.0 |
| 1-Hydroxyethylidene-1,1-diphosphonic acid | 3.0 |
| Sodium sulfite | 3.9 |
| Potassium carbonate | 30.0 |
| Potassium bromide | 1.4 |
| Potassium iodide | 1.3 mg |
| Hydroxylamine sulfate | 2.4 |
| Sulfuric acid salt of developing agent | 15.0 (mmol) |
| Water was added to make the total quantity | 1.0 l |
| pH | 10.05 |
| Bleaching Solution | |
| Ferric sodium ethylenediamine-tetracetate trihydrate | 100.0 |
| Disodium ethylenediaminetetracetate | 10.0 |
| Ammonium bromide | 140.0 |
| Ammonium nitrate | 30.0 |
| Ammonia water (27% ag. soln.) | 6.5 ml |
| Water was added to make the total quantity | 1.0 l |
| pH | 6.0 |
| Fixing Solution | |
| Disodium ethylenediaminetetracetate | 0.5 |
| Sodium sulfite | 7.0 |
| Sodium bisulfite | 5.0 |
| Ammonium thiosulfate aqueous solution (70% ag. soln.) | 170.0 ml |
| Water was added to make the total quantity | 1.0 l |
| pH | 6.7 |
| Stabilizing Solution | |
| Formaldehyde (37% ag. soln.) | 2.0 ml |
| Polyoxyethylene-p-monononylphenyl ether (average polymerization degree: 10) | 0.3 |
| Disodium ethylenediaminetetracetate | 0.05 |
| Water was added to make the total quantity | 1.0 l |
| pH | 5.8 to 8.0 |

Yellow couplers (ExY) were replaced in an equimolar amount shown in Tables 8 and 9 to prepare a color light-sensitive material and processing was in the color developing solution in which the sulfuric acid salts of the developing agents were replaced in an equimolar amount.

After processing, the characteristics of the light-sensitive material was measured with blue light to obtain a maximum density (Dm).

Further, light fastness and a humidity and heat fastness of the processed samples were measured.

Light Fastness

Light fastness was expressed in terms of percentage (%) of the density obtained by irradiating with a fluorescent lamp (10,000 lux) for two weeks to an initial density ($D_0$) = a minimum density + 1.0, which was measured with blue light.

Humidity and Heat Fastness

Humidity and heat fastness was expressed in terms of percentage (%) of the density obtained on storage under conditions of 60° C. and 70% RH for three months to an initial density ($D_0$) = a minimum density + 1, which was measured with blue light.

The results thus obtained are summarized in Tables 8 and 9 below.

TABLE 8

| Sample No. | Yellow Coupler ExY | Developing Agent | Dm | Light Fastness | Humidity & Heat Fastness |
|---|---|---|---|---|---|
| 101 (Comp.) | YC-1 | P-5 | 1.53 | 51% | 54% |
| 102 (Comp.) | YC-2 | P-5 | 1.30 | 90% | 49% |
| 103 (Comp.) | YC-3 | P-5 | 1.09 | 62% | 23% |
| 104 (Comp.) | YC-1 | D-12 | 1.56 | 59% | 56% |
| 105 (Comp.) | YC-2 | D-12 | 1.32 | 92% | 52% |
| 106 (Comp.) | YC-3 | D-12 | 1.10 | 66% | 26% |
| 107 (Comp.) | Y-7 | P-5 | 1.77 | 37% | 75% |
| 108 (Inv.) | Y-7 | D-2 | 1.80 | 68% | 80% |
| 109 (Inv.) | Y-7 | D-12 | 1.83 | 71% | 82% |
| 110 (Inv.) | Y-7 | D-18 | 1.81 | 67% | 78% |
| 111 (Inv.) | Y-7 | D-20 | 1.80 | 68% | 81% |
| 112 (Inv.) | Y-7 | D-30 | 1.80 | 66% | 78% |
| 113 (Inv.) | Y-7 | E-40 | 1.82 | 67% | 78% |
| 114 (Inv.) | Y-7 | E-41 | 1.80 | 63% | 76% |
| 115 (Comp.) | Y-5 | P-4 | 1.80 | 41% | 61% |
| 116 (Inv.) | Y-5 | D-12 | 1.84 | 76% | 84% |
| 117 (Inv.) | Y-5 | D-18 | 1.82 | 72% | 80% |
| 118 (Inv.) | Y-5 | E-5 | 1.81 | 69% | 78% |
| 119 (Inv.) | Y-5 | E-40 | 1.81 | 70% | 79% |
| 120 (Inv.) | Y-19 | D-1 | 1.58 | 71% | 83% |
| 121 (Inv.) | Y-19 | D-5 | 1.53 | 73% | 85% |
| 122 (Inv.) | Y-19 | D-12 | 1.56 | 78% | 90% |

TABLE 8-continued

| Sample No. | Yellow Coupler ExY | Developing Agent | Dm | Light Fastness | Humidity & Heat Fastness |
|---|---|---|---|---|---|
| 123 (Inv.) | Y-19 | E-9 | 1.55 | 70% | 81% |
| 124 (Comp.) | Y-29 | P-5 | 1.55 | 41% | 82% |
| 125 (Inv.) | Y-29 | D-2 | 1.58 | 71% | 86% |
| 126 (Inv.) | Y-29 | D-12 | 1.61 | 74% | 88% |
| 127 (Inv.) | Y-29 | D-18 | 1.58 | 68% | 85% |
| 128 (Inv.) | Y-29 | E-5 | 1.57 | 65% | 83% |
| 129 (Inv.) | Y-29 | E-40 | 1.59 | 68% | 85% |
| 130 (Inv.) | Y-29 | E-41 | 1.58 | 67% | 83% |
| 131 (Comp.) | Y-14 | P-5 | 1.70 | 55% | 65% |
| 132 (Inv.) | Y-14 | D-12 | 1.76 | 81% | 72% |
| 133 (Inv.) | Y-14 | E-40 | 1.73 | 78% | 70% |

As apparent from the results shown in Tables 8 and 9, above light fastness is markedly improved in the examples of the present invention compared with the comparative examples. Further, maximum density (Dm) and humidity and heat fastness are improved as well.

It can be seen that D-12 is most preferable as the developing agent used in the present invention.

EXAMPLE 2

Color light-sensitive materials were prepared in the same manner as in Example 1 except that only the developing agents were replaced and the processing time in the color development (developing time) was set at 1 minute and 15 seconds and 2 minutes and 15 seconds as shown in Table 10 below.

After processing, characteristics were measured with blue light to obtain the gradient $\gamma$ of the line obtained by connecting the point of maximum density (Dm) with the point of $\frac{1}{3}$ of Dm in the characteristic curve. The results thus obtained are summarized in Table 10 below.

TABLE 10

| Sample No. | Yellow Coupler | Developing Agent | Developing Time | Dm | $\gamma$ |
|---|---|---|---|---|---|
| 201 (Comp.) | Y-2 | P-5 | 1'15" | 1.61 | 1.32 |
| 202 (Comp.) | Y-2 | P-5 | 2'15" | 1.77 | 1.50 |
| 203 (Inv.) | Y-2 | D-2 | 1'15" | 1.75 | 1.50 |
| 204 (Inv.) | Y-2 | D-2 | 2'15" | 1.80 | 1.55 |
| 205 (Inv.) | Y-2 | D-12 | 1'15" | 1.81 | 1.56 |
| 206 (Inv.) | Y-2 | D-12 | 2'15" | 1.83 | 1.60 |
| 207 (Inv.) | Y-2 | D-18 | 1'15" | 1.76 | 1.49 |
| 208 (Inv.) | Y-2 | D-18 | 2'15" | 1.81 | 1.55 |
| 209 (Inv.) | Y-2 | D-20 | 1'15" | 1.75 | 1.49 |
| 210 (Inv.) | Y-2 | D-20 | 2'15" | 1.80 | 1.54 |
| 211 (Inv.) | Y-2 | E-40 | 1'15" | 1.77 | 1.51 |
| 212 (Inv.) | Y-2 | E-40 | 2'15" | 1.82 | 1.57 |
| 213 (Inv.) | Y-2 | E-41 | 1'15" | 1.74 | 1.47 |
| 214 (Inv.) | Y-2 | E-41 | 2'15" | 1.80 | 1.53 |
| 215 (Inv.) | Y-4 | D-12 | 1'15" | 1.80 | 1.56 |
| 216 (Inv.) | Y-4 | D-12 | 2'15" | 1.84 | 1.62 |
| 217 (Inv.) | Y-4 | E-40 | 1'15" | 1.78 | 1.51 |
| 218 (Inv.) | Y-4 | E-40 | 2'15" | 1.81 | 1.55 |

As apparent from the results shown in Table 10 above, the developing performance (Dm and $\gamma$) at a developing time of 2 minutes and 15 seconds in comparative examples and at 1 minute and 15 seconds in the examples of the present invention are almost equivalent and it can be seen that rapid processing can be conducted more easily in the examples of the present invention than in the comparative examples.

EXAMPLE 3

Layers having the following compositions were simultaneously coated on a cellulose triacetate film support provided with a subbing layer, whereby a multilayer color light-sensitive material Sample 301 was prepared.

Compositions of Light-Sensitive Layers

The substances used in the respective samples are classified as follows:

| | | | |
|---|---|---|---|
| ExC: | cyan coupler | UV: | UV absorber |
| ExM: | magenta coupler | HBS: | high boiling solvent |
| ExY: | yellow coupler | H: | gelatin hardener |
| ExS: | sensitizing dye | | |

The numerals corresponding to the respective components show the coated amounts expressed in terms of g/m$^2$, provided that the coated amounts of the sensitizing dyes are expressed in terms of mole per mole of silver halide present in the same layer.

| Multilayer Color Light-Sensitive Material 301 | |
|---|---|
| First Layer (anti-halation layer) | |
| Black colloidal silver | silver 0.18 |
| Gelatin | 1.40 |
| ExM-1 | 0.18 |
| ExF-1 | $2.0 \times 10^{-3}$ |
| Second Layer (intermediate layer) | |
| Emulsion G | silver 0.065 |
| 2,5-Di-t-pentadecyl hydroquinone | 0.18 |
| EX-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| Third Layer (low red-sensitive layer) | |
| Emulsion A | silver 0.25 |
| Emulsion B | silver 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-4 | 0.17 |
| ExC-7 | 0.020 |
| UV-1 | 0.070 |
| UV-2 | 0.050 |
| UV-3 | 0.070 |
| HBS-1 | 0.060 |
| Gelatin | 0.87 |
| Fourth Layer (medium red-sensitive layer) | |
| Emulsion D | silver 0.80 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.20 |
| ExC-2 | 0.050 |
| ExC-4 | 0.20 |
| ExC-5 | 0.050 |
| ExC-7 | 0.015 |
| UV-1 | 0.070 |
| UV-2 | 0.050 |
| UV-3 | 0.070 |
| Gelatin | 1.30 |
| Fifth Layer (high red-sensitive layer) | |
| Emulsion E | silver 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.097 |
| ExC-2 | 0.010 |
| ExC-3 | 0.065 |
| ExC-6 | 0.020 |
| HBS-1 | 0.22 |
| HBS-2 | 0.10 |
| Gelatin | 1.63 |
| Sixth Layer (intermediate layer) | |
| Cpd-1 | 0.040 |

-continued

| Multilayer Color Light-Sensitive Material 301 | |
|---|---|
| HBS-1 | 0.020 |
| Gelatin | 0.80 |
| Seventh Layer (low green-sensitive layer) | |
| Emulsion C | silver 0.30 |
| ExS-4 | $2.6 \times 10^{-5}$ |
| ExS-5 | $1.8 \times 10^{-4}$ |
| ExS-6 | $6.9 \times 10^{-4}$ |
| ExM-1 | 0.021 |
| ExM-2 | 0.26 |
| ExM-3 | 0.030 |
| ExY-1 | 0.025 |
| HBS-1 | 0.11 |
| HBS-3 | 0.010 |
| Gelatin | 0.63 |
| Eighth Layer (medium green-sensitive layer) | |
| Emulsion D | silver 0.55 |
| ExS-4 | $2.2 \times 10^{-5}$ |
| ExS-5 | $1.5 \times 10^{-4}$ |
| ExS-6 | $5.8 \times 10^{-4}$ |
| ExM-2 | 0.094 |
| ExM-3 | 0.026 |
| ExY-1 | 0.018 |
| HBS-1 | 0.18 |
| HBS-3 | $8.0 \times 10^{-3}$ |
| Gelatin | 0.50 |
| Ninth Layer (high green-sensitive layer) | |
| Emulsion E | silver 1.55 |
| ExS-4 | $4.6 \times 10^{-5}$ |
| ExS-5 | $1.0 \times 10^{-4}$ |
| ExS-6 | $3.9 \times 10^{-4}$ |
| ExC-1 | 0.015 |
| ExM-1 | 0.013 |
| ExM-4 | 0.065 |
| ExM-5 | 0.019 |
| HBS-1 | 0.24 |
| HBS-2 | 0.10 |
| Gelatin | 1.54 |
| Tenth Layer (yellow filter layer) | |
| Yellow colloidal silver | silver 0.035 |
| Cpd-1 | 0.080 |
| HBS-1 | 0.030 |
| Gelatin | 0.95 |
| Eleventh Layer (low blue-sensitive layer) | |
| Emulsion C | silver 0.18 |
| ExS-7 | $8.6 \times 10^{-4}$ |
| ExY-1 | 0.042 |
| ExY-2 | 0.74 |
| HBS-1 | 0.28 |
| Gelatin | 1.10 |
| Twelfth Layer (medium blue-sensitive layer) | |
| Emulsion D | silver 0.40 |
| ExS-7 | $7.4 \times 10^{-4}$ |
| ExC-7 | $7.0 \times 10^{-3}$ |

-continued

| Multilayer Color Light-Sensitive Material 301 | |
|---|---|
| ExY-2 | 0.14 |
| HBS-1 | 0.050 |
| Gelatin | 0.78 |
| Thirteenth Layer (high blue-sensitive layer) | |
| Emulsion F | silver 0.70 |
| ExS-7 | $2.8 \times 10^{-4}$ |
| ExY-2 | 0.20 |
| HBS-1 | 0.070 |
| Gelatin | 0.69 |
| Fourteenth Layer (first protective layer) | |
| Emulsion G | silver 0.20 |
| UV-4 | 0.11 |
| UV-5 | 0.17 |
| HBS-1 | $5.0 \times 10^{-2}$ |
| Gelatin | 1.00 |
| Fifteenth Layer (second protective layer) | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Further, W-1 to W-3, B-4 to B-6, F-1 to F-17, an iron salt, a lead salt, a gold salt, a platinum salt, an iridium salt, and a rhodium salt were appropriately present in the respective layers in order to improve preservativity, processing performance, anti-pressure performance, anti-mold and fungicidal performance, anti-charging performance, and coating performance.

TABLE 11

| Emulsion | Average AgI Content (%) | Average Grain Size (μm) | Variation Coefficient (%) | Diameter/ Thickness Ratio | Silver Amount Ratio [Core/Middle/Shell] (AgI content) | Grain Structure/Form |
|---|---|---|---|---|---|---|
| A | 4.0 | 0.45 | 27 | 1 | [1/3] (13/1) | Double structure octahedron grain |
| B | 8.9 | 0.70 | 14 | 1 | [3/7] (25/2) | Double structure octahedron grain |
| C | 2.0 | 0.55 | 25 | 7 | — | Uniform structuretabular grain |
| D | 9.0 | 0.65 | 25 | 6 | [12/59/29] (0/11/8) | Triple structure tabular grain |
| E | 9.0 | 0.85 | 23 | 5 | [8/59/33] (0/11/8) | Triple structure tabular grain |
| F | 14.5 | 1.25 | 25 | 3 | [37/63] (34/3) | Double structure octahedron grain |
| G | 1.0 | 0.07 | 15 | 1 | — | Uniform structurefine grain |

In Table 11:

(1) Emulsions A to F are silver bromoiodide emulsions subjected to reduction sensitization with thiourea dioxide and thiosulfonic acid according to the examples of JP-A-2-191938;

(2) Emulsions A to F were subjected to gold sensitization, sulfur sensitization and selenium sensitization in the presence of the spectral sensitizing dyes described in the respective sensitive-layers and sodium thiocyanate according to the examples of JP-A-3-237450;

(3) in preparing the tabular grains, low molecular weight gelatin was used according to the examples of JP-A-l-158426; and (4) in the tabular grains and the regular grains having a grain structure, the dislocation line as described in JP-A-2-237450 was observed with a high voltage electron microscope.

The compounds used in these layers are shown below.

ExC-1
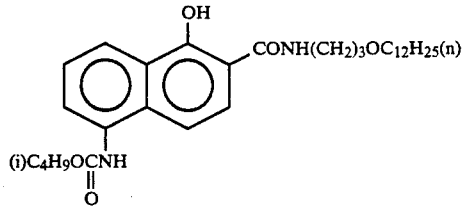
ExC-2
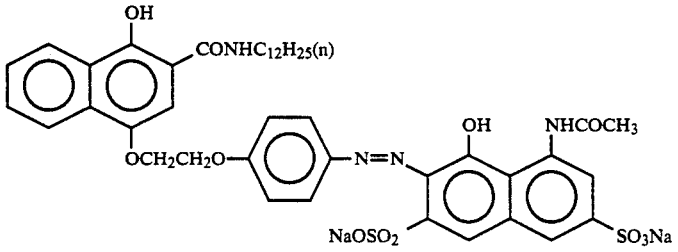
ExC-3
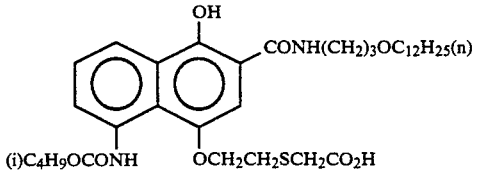
ExC-4
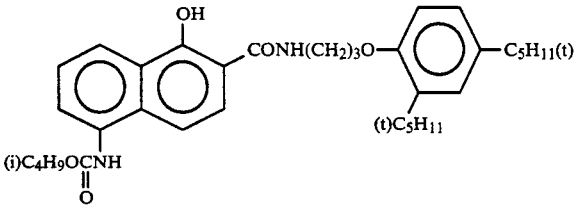
ExC-5
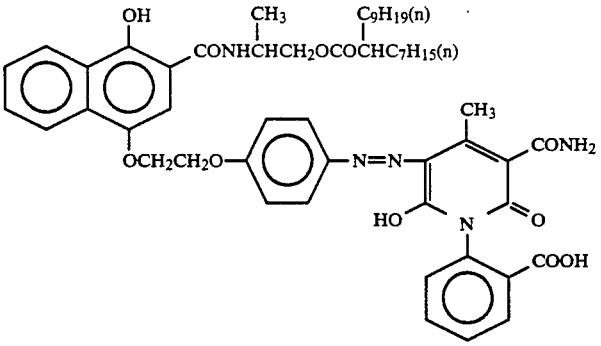
ExC-6
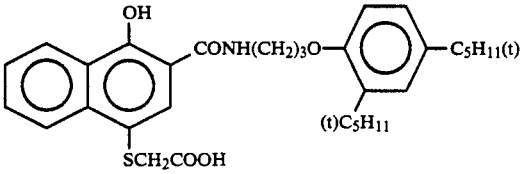

-continued
ExC-7
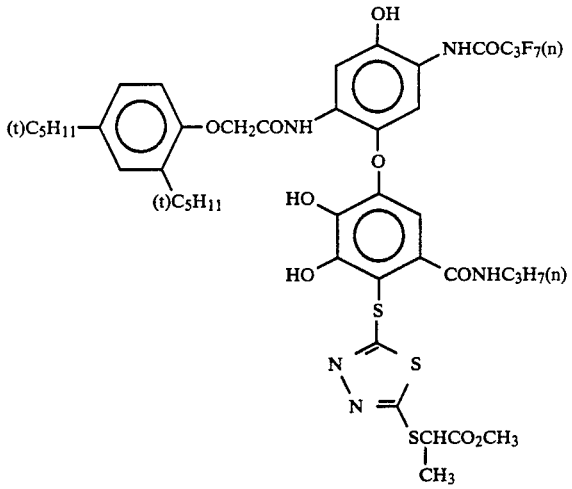
ExM-1
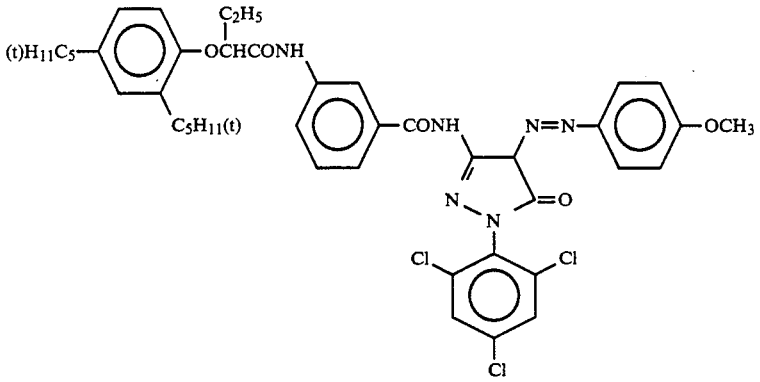
ExM-2
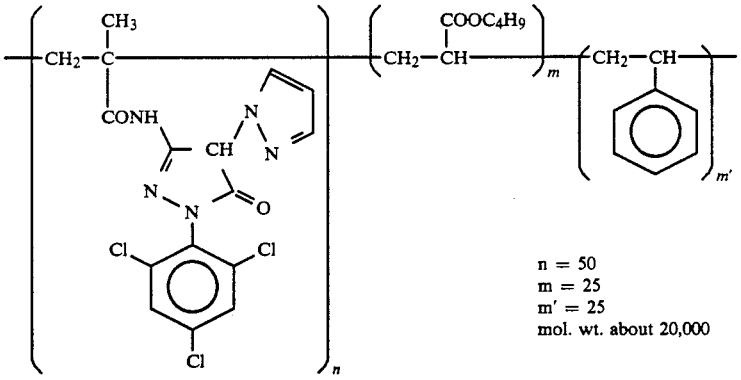
ExM-3
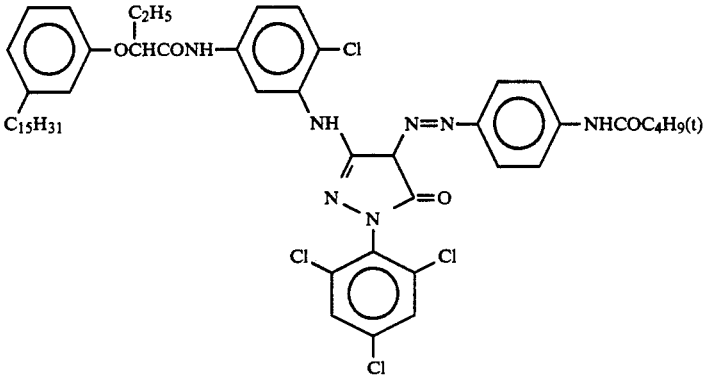

-continued
ExM-4
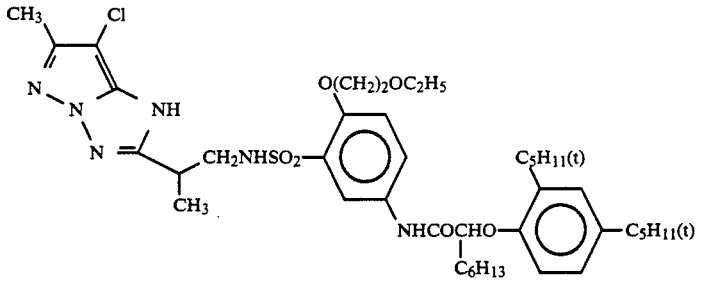
ExM-5
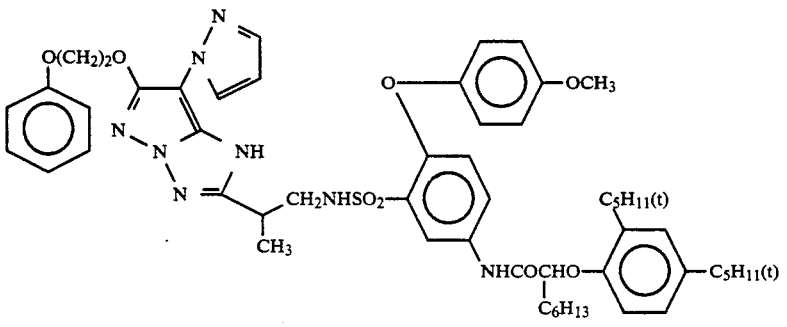
ExY-1
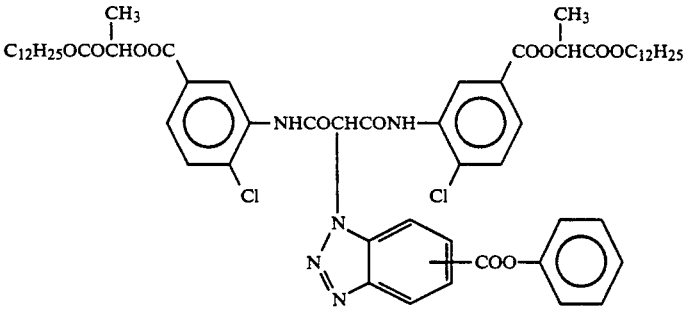
ExY-2
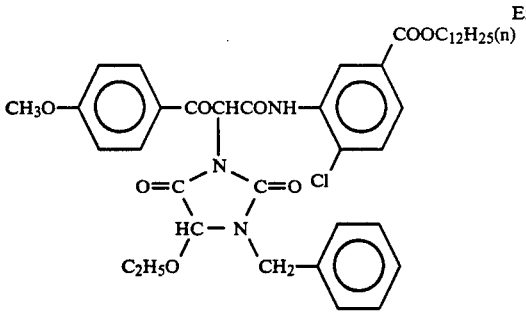
ExF-1
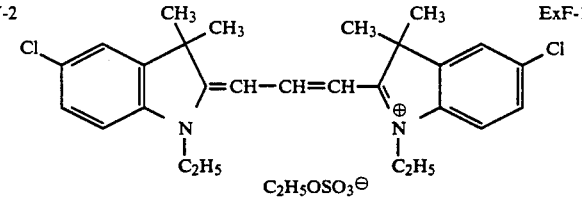
Cpd-1
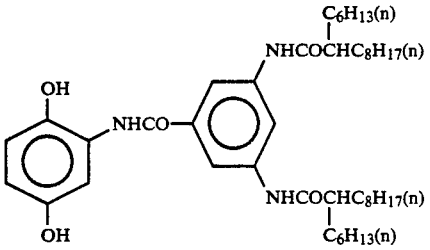
UV-1
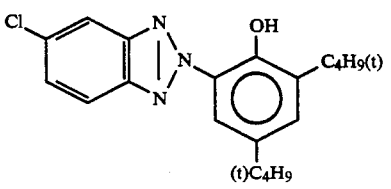

-continued
UV-2
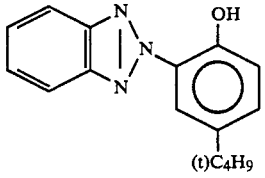
UV-3
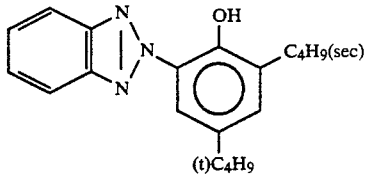
UV-4
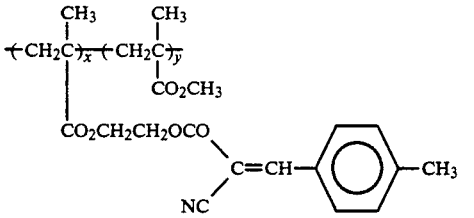
x:y = 70:30 (wt %)
UV-5
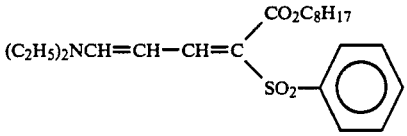
Tricresyl phosphate HBS-1
Di-n-butyl phthalate HBS-2
HBS-3
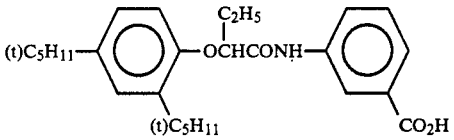
ExS-1
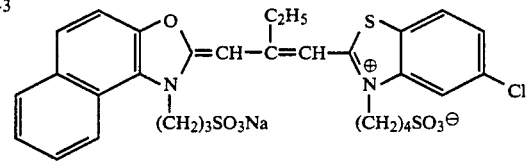
ExS-2
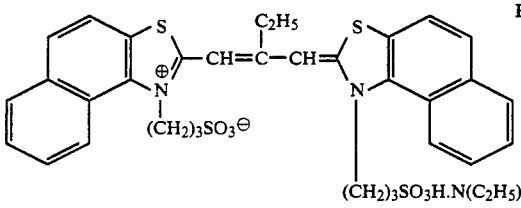
ExS-3
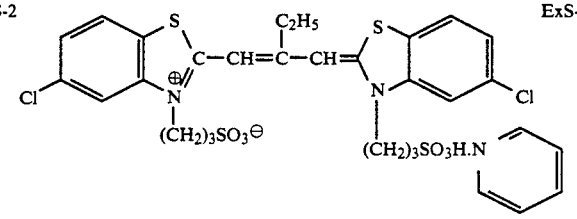
ExS-4
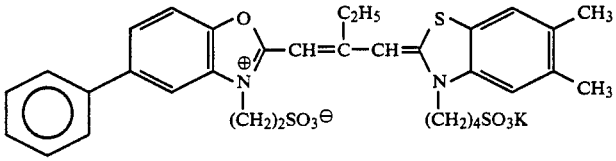
ExS-5
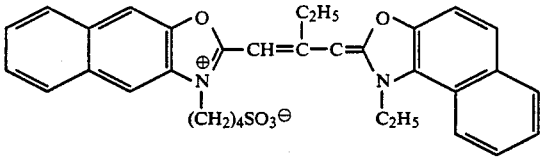
ExS-6
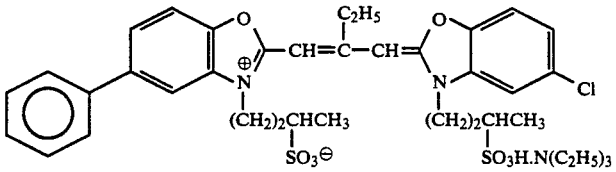
ExS-7
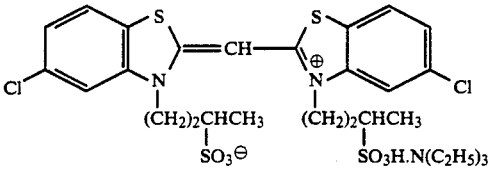
S-1
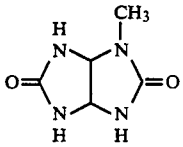

-continued
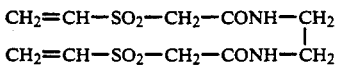
H-1
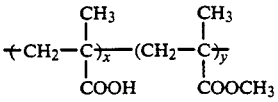
x/y = 10/90
B-1
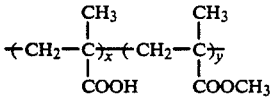
x/y = 40/60
B-2
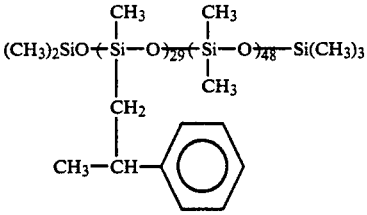
B-3
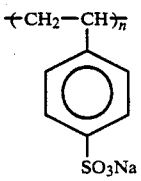
B-4
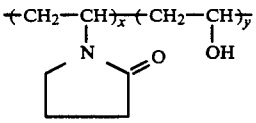
x/y = 70/30
B-5
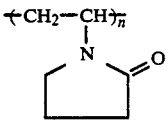
(mol. wt. about 10,000)
B-6
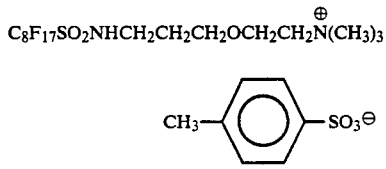
W-1
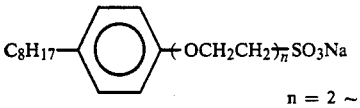
n = 2 ~ 4
W-2
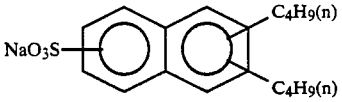
W-3
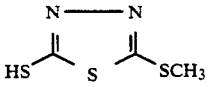
F-1
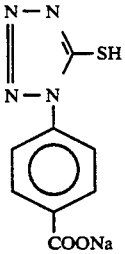
F-2
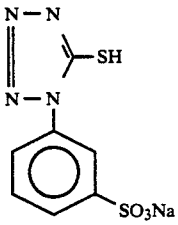
F-3
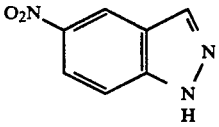
F-4
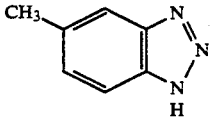
F-5
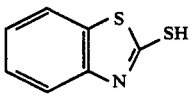
F-6

-continued

F-7

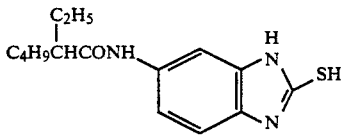

F-8

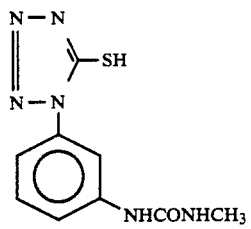

F-9

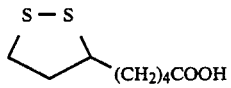

F-10

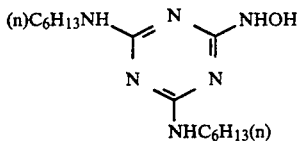

F-11

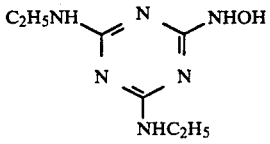

F-12

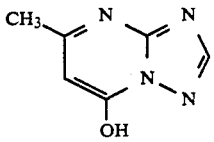

F-13

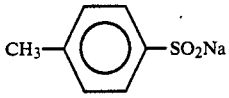

F-14

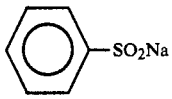

F-15

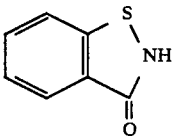

F-16

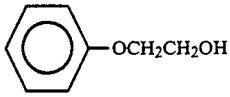

F-17

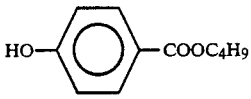

This sample was slit to a 35 mm width and subjected to photographing with a camera. The sample was subjected to the following processings per $m^2$ every day over a period of 15 days. The respective processings were carried out as follows with an automatic developing machine FP-560B manufactured by Fuji Photo Film Co., Ltd.

The processing steps and the compositions of the processing solutions are shown below.

| Step | Processing Time | Processing Temperature | Replenishing Amount | Tank Capacity |
|---|---|---|---|---|
| | Processing Steps | | | |
| Color Developing | 3 minutes & 5 seconds | 38° C. | 600 ml | 17 l |
| Bleaching | 50 seconds | 38° C. | 140 ml | 5 l |
| Bleach/Fixing | 50 seconds | 38° C. | — | 5 l |
| Fixing | 50 seconds | 38° C. | 420 ml | 5 l |
| Washing | 30 seconds | 38° C. | 980 ml | 3.5 l |
| Stabilizing (1) | 20 seconds | 38° C. | — | 3 l |
| Stabilizing (2) | 20 seconds | 38° C. | 560 ml | 3 l |
| Drying | 1 minute & 30 seconds | 60° C. | | |

Note:
replenishing amount: per $m^2$ of the light-sensitive material.

The stabilizing solution flowed from (2) to (1) in a countercurrent system and all of the over-flow washing water solution was introduced to a fixing bath. Notches were provided on the upper parts of the bleaching bath and fixing bath of the automatic developing machine and all of the overflow solution effluent from the bleaching bath and fixing bath by supplying the replenishing solutions thereto was passed into the bleach/fixing bath as replenishing solution. The carried-over amounts of developing solution to the bleaching bath, the bleaching solution to the bleach/fixing bath, the bleach/fixing solution to the fixing bath and the fixing solution to the washing bath were 65, 50, 50 and 50 ml per $m^2$ of the light-sensitive material, respectively. The crossover time for each was 6 seconds and this time was included in the processing time of the preceding bath.

The compositions of the processing solutions used are shown below.

| | (Unit: g) | |
|---|---|---|
| | Tank Solution | Replenishing Solution |
| Developing Solution | | |
| Diethylenetriaminiepentacetic acid | 2.0 | 2.0 |
| 1-Hydroxyethylidene-1,1-diphosphonic acid | 3.3 | 3.3 |
| Sodium sulfite | 3.9 | 5.1 |
| Potassium carbonate | 37.5 | 39.0 |
| Potassium bromide | 1.4 | 0.4 |
| Potassium iodide | 1.3 mg | — |
| Hydroxylamine sulfate | 2.4 | 3.3 |
| Sulfate of above P-5 (developing agent) | 4.5 | 6.0 |
| Water was added to make the total quantity | 1.0 l | 1.0 l |
| pH | 10.05 | 10.15 |
| Bleaching Solution | | |
| Ferric ammonium 1,3-diaminopropanetetracetic acid monohydrate | 130 | 195 |
| Ammonium bromide | 70 | 105 |
| Ammonium nitrate | 14 | 21 |
| Hydroxyacetic acid | 50 | 75 |
| Acetic acid | 40 | 60 |
| Water was added to make the total quantity | 1.0 l | 1.0 l |
| pH was adjusted with ammonia water to | 4.4 | 4.4 |
| Bleach/Fixing Tank Solution | | |
| The mixed solution of the above bleaching-starting solution and the following fixing solution in a ratio of 15 to 85 by volume. (pH: 7.0) | | |
| Fixing Solution | | |
| Ammonium sulfite | 19 | 57 |
| Ammonium thiosulfate aqueous solution 700 g/liter) | 280 ml | 840 ml |
| Imidazole | 15 | 45 |
| Ethylenediaminetetracetic acid | 15 | 45 |
| Water was added to make the total quantity | 1.0 l | 1.0 l |
| pH (adjusted with ammonia water and acetic acid) | 7.4 | 7.45 |

Rinsing Water

City water was introduced into a mixed bed type column filled with an H-type strong acidic cation exchange resin (Amberlite TM IR-120B) and an OH type strong base anion exchange resin (Amberlite TM IRA-400), each manufactured by Rohm & Haas Co., Ltd., to reduce the calcium and magnesium ion concentrations to 3 mg/liter or less, and subsequently sodium dichloroisocyanurate 20 mg/liter and sodium sulfate 150 mg/liter were added. The pH range of this solution was within the range of 6.5 to 7.5.

| Stabilizing Solution Common to Both the Tank Solution and Replenishing Solution | |
|---|---|
| Sodium p-toluenesulfinate | 0.03 |
| Polyoxyethylene-p-monononylphenyl ether (average polymerization degree: 10) | 0.2 |
| Disodium ethylenediaminetetracetate | 0.05 |
| 1,2,4-Triazole | 1.3 |
| 1,4-bis(1,2,4-Triazole-1-yl-methyl) piperazine | 0.75 |
| Water was added to make the total | 1.0 l |

-continued

| Stabilizing Solution Common to Both the Tank Solution and Replenishing Solution | |
|---|---|
| quantity | |
| pH | 8.5 |

Multilayer light-sensitive material 301 which was processed at the above processing steps was designated as Sample 301 and the light fastness and humidity and heat fastness thereof were measured in the same manner as in Example 1.

Samples 302 to 310 were prepared in the same manner as Sample 301 except that ExY-2 present in the eleventh, twelfth and thirteenth layers of the multilayer light-sensitive material 301 was replaced with an equimolar amount of the yellow couplers shown in Table 12 below and further the sulfate of compound P-5, above present in the color developing solution was replaced with the sulfates of the developing agents in an equimolar amount as shown in Table 12 below.

TABLE 12

| Sample No. | Yellow Coupler | Developing Agent | Light Fastness | Humidity & Heat Fastness |
|---|---|---|---|---|
| 301 (Comp.) | ExY-2 | P-5 | 55% | 51% |
| 302 (Comp.) | ExY-2 | D-12 | 60% | 56% |
| 303 (Comp.) | Y-2 | P-5 | 39% | 71% |
| 304 (Inv.) | Y-2 | D-2 | 71% | 80% |
| 305 (Inv.) | Y-2 | D-12 | 75% | 81% |
| 306 (Inv.) | Y-2 | E-40 | 65% | 79% |
| 307 (Comp.) | Y-29 | P-5 | 43% | 79% |
| 308 (Inv.) | Y-29 | D-12 | 76% | 87% |
| 309 (Inv.) | Y-29 | D-18 | 70% | 84% |
| 310 (Inv.) | Y-29 | E-41 | 68% | 80% |

As apparent from the results shown in Table 12 above, it can be seen that light fastness is markedly improved in the samples of the present invention compared with the comparative samples and that the humidity and heat fastness is improved as well. Further, processing rapidity was checked and it was confirmed that it was surprisingly improved as well in the multilayer light-sensitive material.

Further, ExY-2 present in any one or two layers of the eleventh, twelfth and thirteenth layers of the multilayer light-sensitive material 301 was replaced with an equimolar amount of the yellow couplers of the present invention. The samples thus prepared were processed with the developing agent of the present invention and the effects of the present invention could similarly be seen.

EXAMPLE 4

Samples were prepared in the same manner as Example 1 described in JP-A-2-854 except that only coupler C-5 present in the twelfth layer and coupler C-7 present in the thirteenth layer in Sample 101 of the above Example 1 were replaced with an equimolar amount of yellow couplers of the present invention. The samples thus prepared were processed in the same manner as in Example 1 above except that N-ethyl-N-(β-methanesulfonamidethyl)-3-methyl-4-aminoaniline present in the color developing solution of Example 1 of JP-A-2-2854 was replaced with an equimolar amount of the yellow couplers of the present invention.

The light fastness and the humidity and heat fastness these samples were determined in the same manner as Example 1 it was conformed that they were improved as well as in Examples 1 and 3.

Further, it was confirmed that the developing time was surprisingly shortened as well as in Example 2.

While the invention has been described in detail and with reference to specific embodiments thereof, it will be apparent to one skilled in the art that various changes and modifications can be made therein without departing from the spirit and scope thereof.

What is claimed is:

1. A dye image-forming method comprising color developing an image wise exposed silver halide color photographic material comprising a support having thereon at least one silver halide emulsion layer containing 60 mol % or more of silver bromide and containing at least one acylacetamide yellow coupler having an acyl group represented by the following formula (YI)

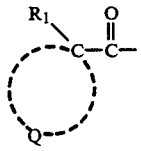

Formula (YI)

wherein $R_1$ represents a monovalent group; Q represents a group of atoms necessary to form a 3- to 5-membered hydrocarbon ring or a 3- to 5-membered heterocyclic ring having therein at least one hetero atom selected from N, O, S and P together with C; provided that $R_1$ is not a hydrogen atom and is not combined with Q to form a ring; with a developing solution containing at least one of the aromatic primary amine color developing agents represented by the following Formula (D) or (E):

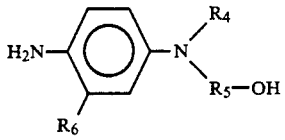

Formula (D)

wherein $R_4$ represents a linear or branched alkyl group having 1 to 6 atoms or a linear or branched hydroxyalkyl group having 3 to 6 carbon atoms; $R_5$ represents a linear or branched alkylene group having 3 to 6 carbon atoms or a linear or branched hydroxyalkylene group having 3 to 6 carbon atoms; $R_6$ represents a hydrogen atom, a linear or branched alkyl group having 1 to 4 carbon atoms or a linear or branched alkoxy group having 1 to 4 carbon atoms;

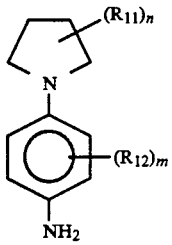

Formula (E)

wherein $R_{11}$ represents a halogen atom, an alkyl group, an aryl group, a heterocyclic group, a cyano group, a nitro group, a hydroxyl group, a carboxyl group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclicoxy group, an azo group, an acyloxy group, a carbamoyloxy group, a silyl group, a silyloxy group, an aryloxycarbonylamino group, an imide group, a heterocyclicthio group, a sulfinyl group, a phosphonyl group, an aryloxycarbonyl group, or an acyl group; n represent 0 or an integer of 1 to 8, provided that when n is 2 or more, the $R_{11}$ may be the same or different; $R_{12}$ represents a halogen atom, an alkyl group, an aryl group, a heterocyclic group, a cyano group, a nitro group, a hydroxyl group, a carboxyl group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclicoxy group, an azo group, an acyloxy group, a carbamoyloxy group, a silyl group, a silyloxy group, an aryloxycarbonylamino group, an imide group, a heterocyclicthio group, a sulfinyl group, a phosphonyl group, an aryloxycarbonyl group, or an acyl group; and m represents 0 or an integer of 1 to 4, provided that when m is 2 or more, the $R_{12}$ may be the same or different from each other and may form a ring.

2. The dye image-forming method of claim 1, wherein said acylacetamide yellow coupler having an acyl group represented by the Formula (YI) is a yellow coupler of the Formula (YII):

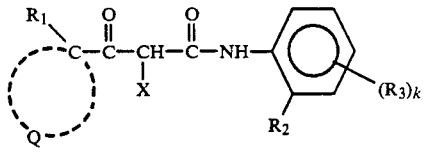

(YII)

wherein $R_1$ represents a monovalent atom or group other than a hydrogen atom; Q represents a group of atoms necessary to form a 3- to 5-membered hydrocarbon ring or a 3- to 5-membered heterocyclic ring having therein at least one hetero atom selected from N, S, O and P together with C; $R_2$ represents a hydrogen atom, a halogen atom, an alkoxy group, an aryloxy group, an alkyl group, or an amino group; $R_3$ represents a group capable of substitution on a benzene ring; X represents a hydrogen atom or a group capable of release upon coupling with the oxidation product of an aromatic primary amine developing agent; and k represents 0 or an integer of 1 to 4, provided that when k is plural, the plurality of $R_3$'s may be the same or different.

3. The dye image-forming method of claim 2, wherein $R_1$ is an alkyl group having 1 to 30 carbon atoms; Q is a group of nonmetal atoms which form a 3- to 5-membered hydrocarbon ring together with carbon; $R_2$ is a chlorine atom, a fluorine atom, an alkyl group having 1 to 6 carbon atoms, an alkoxy group having 1 to 8 carbon atoms or an aryloxy group having 6 to 24 carbon atoms; $R_3$ is a halogen atom, a cyano group, a trifluoromethyl group, an alkoxy group, an alkoxycarbonyl group, an aryloxycarbonyl group, a carbonamide group, a sulfonamide group, a carbamoyl group, or a sulfamoyl group; and X is a group having the following Formula (Y-1), (Y-2) or (Y-3):

(Y-1)

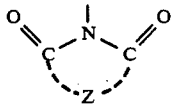

(Y-2)

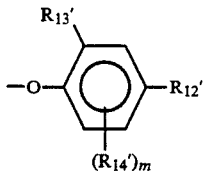

(Y-3)

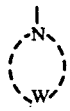

wherein Z represents —O—$CR_4'(R_5')$—, —S—$CR_4'(R_5')$—, —$NR_6$ '—$CR_4'(R_5')$—, —$NR_6'$—$NR_7'$—, or —$CR_4'(R_5')$—$CR_8'(R_9')$—, wherein $R_4'$, $R_5'$, $R_8'$ and $R_9'$ each represent a hydrogen atom, an alkyl group, an aryl group, an alkoxy group, an aryloxy group, an alkylthio group, an arylthio group, an alkylsulfonyl group, an arysulfonyl group, or an amino group; $R_6'$ and $R_7'$ each represent a hydrogen atom, an alkyl group, an aryl group, an alkylsulfonyl group, an arylsulfonyl group, or an alkoxycarbonyl group; $R_{10}'$ and $R_{11}'$ each represent a hydrogen atom, an alkyl group, or an aryl group; $R_{10}'$ and $R_{11}'$ may combine with each other and form a benzene ring; $R_4'$ and $R_5'$, $R_5'$ and $R_6'$, $R_6'$ and $R_7'$, or $R_4'$ and $R_8'$ may combine and form a ring; at least one of $R_{12}'$ and $R_{13}'$ is selected from a halogen atom, a cyano group, a nitro group, a trifluoromethyl group, a carboxyl group, an alkoxycarbonyl group, an carbonamide group, a sulfonamide group, a carbamoyl group, a sulfamoyl group, an alkylsulfonyl group, an arylsulfonyl group, and an acyl group, and the other may be a hydrogen atom, an alkyl group or an alkoxy group; $R_{14}'$ represents the same group as that defined for $R_{12}'$ or $R_{13}'$; m represents 0 or an integer of 1 to 2; and W represents a group of nonmetal atoms necessary to form a pyrrole ring, a pyrazole ring, an imidazole ring, or a triazole ring together with N.

4. The dye image-forming method of claim 1, wherein $R_5$ in Formula (D) represents an alkylene group having 3 to 4 carbon atoms.

5. The dye image-forming method of claim 1, wherein $R_5$ in Formula (D) represents a tetramethylene group.

6. The dye image-forming method of claim 1, wherein $R_4$ in Formula (D) represents an alkyl group having 1 to 4 carbon atoms.

7. The dye image-forming method of claim 1, wherein $R_6$ in Formula (D) presents a methyl group or an ethyl group.

8. The dye image-forming method of claim 1, wherein $R_6$ in Formula (D) represents a methyl group or an ethyl group.

9. The dye image-forming method of claim 8, wherein $R_5$ represents a tetramethylene group.

10. The dye image-forming method of claim 1, wherein $R_5$ in Formula (D) represents a tetramethylene group; and $R_4$ represents an alkyl group having 1 to 4 carbon atoms.

11. The dye image-forming method of claim 1, wherein the aromatic primary amine color developing agents are represented by Formula (F):

(F)

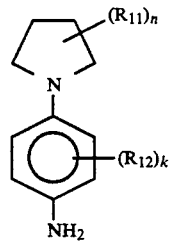

wherein $R_{11}$, $R_{12}$ and n are as defined in formula (E), and k is 0 or 1.

12. The dye image-forming method of claim 1, wherein the aromatic primary amine color developing agents are represented by Formula (G):

(G)

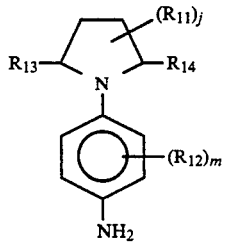

wherein $R_{11}$, $R_{12}$ and m are as defined in formula (E), j represents 0 or an integer of 1to 6, and when j is two or more, the plurality of $R_{11}$ may be the same or different, and $R_{13}$ and $R_{14}$, which may be the same or different, each represents a substituted or unsubstituted alkyl group.

13. The dye image-forming method of claim 1, wherein the aromatic primary amine color developing agents are represented by Formula (H):

(H)

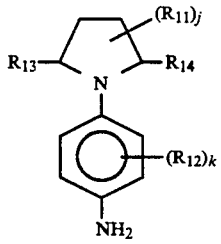

wherein $R_{11}$, $R_{12}$ and m are as defined in formula (E), j represents 0 or an integer of 1to 6, and when j is two or more, the plurality of $R_{11}$ may be the same or different, and $R_{13}$ and $R_{14}$, which may be the same or different, each represents a substituted or unsubstituted alkyl group; and k is 0 or 1.

* * * * *